US005224461A

United States Patent [19]

Nakaniwa

[11] Patent Number: 5,224,461

[45] Date of Patent: Jul. 6, 1993

[54] SELF-DIAGNOSING APPARATUS AND METHOD FOR FUEL SUPPLY CONTROL SYSTEM APPLICABLE TO INTERNAL COMBUSTION ENGINE

[75] Inventor: Shimpei Nakaniwa, Gumma, Japan

[73] Assignee: Japan Electronic Control Systems Co., Ltd., Isezaki, Japan

[21] Appl. No.: 890,118

[22] Filed: May 29, 1992

[51] Int. Cl.[5] ..... F02M 51/00

[52] U.S. Cl. ..... 123/688

[58] Field of Search ..... 123/688, 416, 417, 480; 364/431.05

[56] References Cited

U.S. PATENT DOCUMENTS

| | | | |
|---|---|---|---|
| 4,844,038 | 7/1989 | Yamato et al. | 123/688 |
| 4,924,836 | 5/1990 | Uchida et al. | 123/489 |
| 5,065,728 | 11/1991 | Nakinawa | 123/688 |
| 5,090,387 | 2/1992 | Mayor et al. | 123/688 |

OTHER PUBLICATIONS

JP-1-60-90944 Japanese Abstract, dated Oct. 24, 1983.

JP-A-1-6H14 190142 Japanese Abstract, dated Sep. 12, 1985.

*Primary Examiner*—Raymond A. Nelli

*Attorney, Agent, or Firm*—Foley & Lardner

[57] ABSTRACT

A self diagnosing apparatus and method for a fuel supply control system in an internal comustion engine are disclosed in which since an air/fuel mixture ratio feedback controlled variable is set so that an actual air/fuel mixture ratio is approached to a target (stoichiometric) air/fuel mixture ratio and movement (incremental or decremental change width) of the air/fuel mixture ratio feedback-controlled variable indicates a deviation of the actual air/fuel mixture ratio from the target air/fuel mixture ratio, a diagnosis of the air/fuel mixture ratio controlled state by means of the fuel supply control system is carried out on the basis of at least one of either a total sum of each magnitude by which the air/fuel mixture ratio feedback controlled variable is changed to enrich or enlean the air/fuel mixture ratio so as to approach it to the target air/fuel mixture ratio or a control duration of time during which the air/fuel mixture ratio feedback control variable is set to control the air/fuel mixture ratio.

20 Claims, 11 Drawing Sheets

SELF-DIAGNOSING APPARATUS AND METHOD FOR FUEL SUPPLY CONTROL SYSTEM APPLICABLE TO INTERNAL COMBUSTION ENGINE

BACKGROUND OF THE INVENTION

1. Field of The Invention

The present invention relates generally to an apparatus and method for self-diagnosing a fuel supply control system applicable to an internal combustion engine, and, more particularly, relates to the self-diagnosing apparatus and method for the system of the fuel supply quantity control system having an air/fuel mixture ratio feedback control function in which with an air/fuel mixture ratio controlled state correlated to an exhaust gas characteritic taken into account, the diagnostic operation for the fuel supply control system can be carried out.

2. Description of The Background Art

A U.S. Pat. No. 4,924,836 exemplifies an air/fuel mixture ratio learning and controlling system having an air/fuel mixture ratio feedback correction control function and applicable to an electronically controlled fuel injection system of an internal combustion engine.

In addition, a U.S. patent application Ser. No. filed on Apr. 16, 1992 titled SYSTEM AMD METHOD FOR LEARNING AND CONTROLLING AIR/FUEL MIXTURE RATIO FOR INTERNAL COMBUSTION ENGINE also exemplifies the similar system and method for learning and controlling the air/fuel mixture ratio.

In such previously proposed air/fuel mixture ratio learning and controlling systems, an air/fuel mixture ratio feedback correction control is carried out such that a basic fuel injection quantity Tp calculated from two parameters indicating an engine during condition (for example, an intake air quantity Q and engine revolution speed N) related to sucked air quantity is corrected with an air/fuel mixture ratio feedback correction coefficient LMD set through a proportion-integration control of the air/fuel mixture ratio on the basis of rich or lean determination of the actual air/fuel mixture ratio by means of an oxygen concentration sensor installed in an exhaust system of the engine with respect to a target air/fuel mixture ratio (for example, a stoichiometric air/fuel mixture ratio) so that the actual air/fuel mixture ratio is feedback-controlled so as to be matched with the target air/fuel mixture ratio.

A deviation of the air/fuel mixture ratio feedback correction coefficient LMD from a reference value (target convergence value) is learned for the respective driving regions defined according to the intake air quantity Q and engine revolution speed N, the whole engine driving region being divided into a plurality of the driving regions, so as to derive a learning correction coefficient KBLRC at the corresponding driving region. The basic fuel injection quantity Tp is corrected with the learning correction coefficient KBLRC so that a base (or bare) air/fuel mixture ratio derived without the feedback correction coefficient LMD is substantially coincident with the target air/fuel mixture ratio. During the air/fuel mixture ratio feedback control mode, the basic fuel injection quantity Tp is further corrected with the feedback correction coeffcient LMD thereby to calculate a final fuel injection quantity Ti.

The correction of the basic fuel injection quantity Tp corresponding to a required value of the air/fuel mixture ratio different for each engine driving condition can be carried out and the air/fuel mixture ratio feedback correction coefficient LMD becomes stable in the vicinity to the reference value so that an air/fuel mixture ratio controlability can be improved.

On the other hand, when, in such previously proposed fuel injection quantity controlling systems as described above, failures, deteriorations, and/or variations in the charachateristics of products during manufactures thereof, i.e., components in the fuel supply control systems such as fuel injection valve(s), fuel pump, and airflow meter to detect the intake air quantity are generated, the base air/fuel mixture ratio is usually deviated from the target air/fuel mixture ratio so that harmful components such as CO, HC, and NOx included in the exhaust gas are increased.

A self-diagnosing method for monitoring a worsening of the exhaust gas characteristic due to the deviation of the base air/fuel mixture ratio from the target air/fuel mixture ratio may include a step of deriving an average value of the learning correction coefficient KBLRC (which is the result of learning of the requested correction value to achieve the target air/fuel mixture ratio for the respective driving regions) and a step of determining that the learning correction level becomes large due to occurrence of some abnormality in the fuel supply controlling system when the average value of KBLRC is deviated by a predetermined value from an initial value of KBLRC.

As appreciated from FIGS. 13 through 16, however, although the deviation of the average base air/fuel mixture ratio has the same level, a change (or gradient) according to the driving condition in the air/fuel mixture ratio deviation characteristic representing the base air/fuel mixture ratio devation which is varied (or has a gradient) according to the engine driving condition (for example, intake air quantity) causes the characteristic of exhaust gas to be differed according to the driving condition. Consequently, many cases occur in which the exhaust gas characteristic (percentage of each of all harmful components falls in a statutory limit value (as shown in FIG. 3, no change in the error rate on the deviation in the air/fuel mixture ratio occurs) and in which the percentage of either only NOx or only CO and HC exceeds the statutory limit value (as shown in FIGS. 14 or 15, the change in the error rate depending on the driving condition occurs).

It is, therefore, difficult to determine accurately a state of the deviation of the air/fuel mixture ratio resulting in the worsening in the exhaust gas characteristic from the average value of the learning correction coefficient KBLRC indicating the level of the average base air/fuel mixture ratio deviation.

In addition, in such a situation that the correction of the basic fuel injection quantity Tp according to the driving condition cannot follow sufficiently the difference in the correction request according to the difference in the engine driving condition during a period of engine revolutions before the air/fuel mixture ratio learning is greatly advanced, a stepwise difference occurs in the base air/fuel mixture ratio at the time of the engine transient driving condition so as to give an ill effect on the exhaust gas characteristic as appreciated from FIG. 10. There is an industrial demand to perform the self-diagnosing system contained in the fuel injection controlling system itself self-diagnose against the state of controlling the air/fuel mixture ratio and to make it alert the worsening of the exhaust gas characteristic even in a state where the learning of the air/fuel mixture ratio is insufficiently advanced. However, in a state where the correction request is not sufficiently taken into the learning correction coefficient, it is not possible for the self-diagnose system to perform an accurate self diagnose against the air/fuel mixture ratio control state on the basis of the learning value and, therefore, the alert of the worsensing of the exhaust gas characteristic cannot be carried out until the learning on the deviation of the actual air/fuel mixture ratio from the target air/fuel mixture ratio is sufficiently advanced.

As described above, in the self diagnose of the air/fuel mixture control state on the basis of the average value of the learning correction coefficient KBLRC, it is difficult to operate the self diagnose system so as to perform self diagnose having a correlation to the exhaust gas characteristic and it is not posible to perform the accurate self diagnose before the learning is sufficiently advanced.

Consequently, in a case where the worsening of the air/fuel mixture ratio control state wherein the percentage of the harmful components in the exhaust gas exceeds the statutory limit value is sequentially and arbitrarily monitored, the self diagnose system described above cannot be adapted to the monitoring and determination of the worsening of the air/fuel mixture ratio.

SUMMARY OF THE INVENTION

It is, therefore, a principal object of the present invention to provide a self diagnose apparatus and method for a fuel supply system of an internal combustion engine which can achieve the self diagnose against the air/fuel mixture ratio control state correlated to the exhaust gas characteristic on the basis of the feedback control of the air/fuel mixture ratio and which can achieve a sequential monitoring of a change in the air/fuel mixture ratio control state which brings out the worsening of the exhaust gas characteristic.

The above-described object can be achieved by providing a self diagnosing apparatus for a fuel supply control system in an internal combustion engine, comprising: a) first detecting means for detecting an air/fuel mixture ratio of an air/fuel mixture supplied to the engine and outputting a first signal indicative of the actual air/fuel mixture ratio; b) second detecting means for detecting an engine driving condition and outputting a second signal indicative of the engine driving condition; b) air/fuel mixture ratio feedback controlled variable setting means, responsive to the output first and second signals from the first and second detecting means, for comparing the actual air/fuel mixture ratio with a target air/fuel mixture ratio and for setting and determining an air/fuel mixture ratio feedback controlled variable on the basis of the first and second signals which serves to correct the air/fuel mixture ratio of the air/fuel mixture to be supplied to the engine according to a result of comparison so that the actual air/fuel mixture ratio is approached to a target air/fuel mixture ratio; c) air/fuel mixture ratio decrement/increment correcting means for controlling the fuel supply quantity related to the air/fuel mixture ratio to be supplied to the engine so as to correct incrementally or decrementally the actual air/fuel mixture ratio on the basis of the air/fuel mixture feedback controlled variable set by the air/fuel mixture feedback controlled variable setting means; and d) air/fuel mixture ratio increment/decrement control diagnosing means for diagnosing an air/fuel mixture ratio controlled state of the fuel supply control system on the basis of at least one of either a magnitude by which the air/fuel mixture ratio feedback controlled variable is changed to richen or lean the air/fuel mixture ratio so as to approach the actual air/fuel mixture ratio to the target air/fuel mixture ratio or a control duration of time during which the fuel supply control system executes the correction on the actual air/fuel mixture ratio by means of the air/fuel mixture ratio feedback controlled variable.

The above-described object can also be achieved by providing a self diagnosing apparatus for a system for controlling and learning an air/fuel mixture ratio applicable to an internal combustion engine installed in an automotive vehicle, comprising: a) first means for detecting an engine driving condition including a driving parameter related to an intake air quantity sucked into the engine; b) second means for setting a basic fuel supply quantity Tp on the basis of the engine driving condition; c) third means for detecting an air/fuel mixture ratio of the supplied air/fuel mixture of theengine; d) fourth means for comparing the detected air/fuel mixture ratio with a target air/fuel mixture ratio and for setting an air/fuel mixture ratio feedback correction coefficient LMD used to correct the basic fuel injection quantity so as to approach the actual air/fuel mixture ratio to the target air/fuel mixture ratio; e) fifth means for rewritably storing an air/fuel mixture ratio learning correction coefficient KBLRC for each driving region, a whole driving region on the engine driving condition being divided into a plurality of subdivided driving regions and the learning correction coefficient being used to correct the basic fuel supply quantity; f) sixth means for learning a deviation of a value of the air/fuel mixture ratio feedback correction coefficient to a target convergence value and for modifying and rewriting the air/fuel mixture ratio learning correction coefficient stored so as to correspond to one of the dubdivided driving regions in the fifth means so that the deviation thereof is reduced; g) seventh means for determining the present corresponding driving region in the fifth means as a learned region when the value of the air/fuel mixture ratio feedback correction coefficient substantially coincides with the target convergence value and for storing a result of determination on the learned region according to each driving region; h) eighth means for driving a final fuel supply quantity on the basis of the basic fuel injection quantity Tp, air/fuel mixture ratio feedback correction coefficient LMD, and the learned air/fuel mixture ratio learning correction coefficient KBLRC stored so as to correspond to the present driving region, the fuel quantity being a quantity of fuel to be supplied to the engine; and i) ninth means for diagnosing an air/fuel mixture ratio controlled state of the fuel supply control system on the basis of at least one of either a sum of a magnitude by which the air/fuel mixture ratio feedback correction coefficient LMD is decrementally or incrementally changed to richen or lean the air/fuel mixture ratio so as to approach the actual air/fuel mixture ratio to the target air/fuel mixture ratio or a control duration of time during which the fuel supply control system executes the correction of the basic fuel supply quantity to calculate the final fuel supply quantity on the actual air/fuel mixture ratio by means of the air/fuel mixture ratio feedback correction coefficient LMD.

The above-described object can also be achieved by providing a self diagnosing method for a system for controlling and learning an air/fuel mixture ratio applicable to an internal combustion engine installed in an automotive vehicle, comprising the steps of: a) detecting an engine driving condition including a driving parameter related to an intake air quantity sucked into the engine; b) setting a basic fuel supply quantity Tp on the basis of the engine driving condition; c) detecting an air/fuel mixture ratio of the supplied air/fuel mixture of the engine; d) comparing the detected air/fuel mixture ratio with a target air/fuel mixture ratio and setting an air/fuel mixture ratio feedback correction coefficient LMD used to correct the basic fuel injection quantity so as to approach the actual air/fuel mixture ratio to the target air/fuel mixture ratio; e) rewritably storing an air/fuel mixture ratio learning correction coefficient KBLRC for each driving region, a whole driving region on the engine driving condition being divided into a plurality of subdivided driving regions and the learning correction coefficient being used to correct the basic fuel supply quantity; f) learning a deviation of a value of the air/fuel mixture ratio feedback correction coefficient to a target convergence value and modifying and rewriting the air/fuel mixture ratio learning correction coefficient stored so as to correspond to one of the dubdivided driving regions so that the deviation thereof is reduced; g) determining the present corresponding driving region in the fifth means as a learned region when the value of the air/fuel mixture ratio feedback correction coefficient substantially coincides wih the target convergence value and storing a result of determination on the learned region according to each driving region; h) driving a final fuel supply quantity on the basis of the basic fuel injection quantity Tp, air/fuel mixture ratio feedback correction coefficient LMD, and the learned air/fuel mixture ratio learning correction coefficient KBLRC stored so as to correspond to the present driving region, the fuel quantity being a quantity of fuel to be supplied to the engine; and i) self diagnosing an air/fuel mixture ratio controlled state of the fuel supply control system on the basis of at least one of either a sum of a magnitude by which the air/fuel mixture ratio feedback correction coefficient LMD is decrementally or incrementally changed to richen or lean the air/fuel mixture ratio so as to approach the actual air/fuel mixture ratio to the target air/fuel mixture ratio or a control duration of time during which the fuel supply control system executes the correction of the basic fuel supply quantity to calculate the final fuel supply quantity on the actual air/fuel mixture ratio by means of the air/fuel mixture ratio feedback correction coefficient LMD.

DESCRIPTION OF THE PREFERRED EMBODIMENTS

Reference will, hereinafter, be made to the drawings in order to facilitate a better understanding of the present invention.

Figure 1:
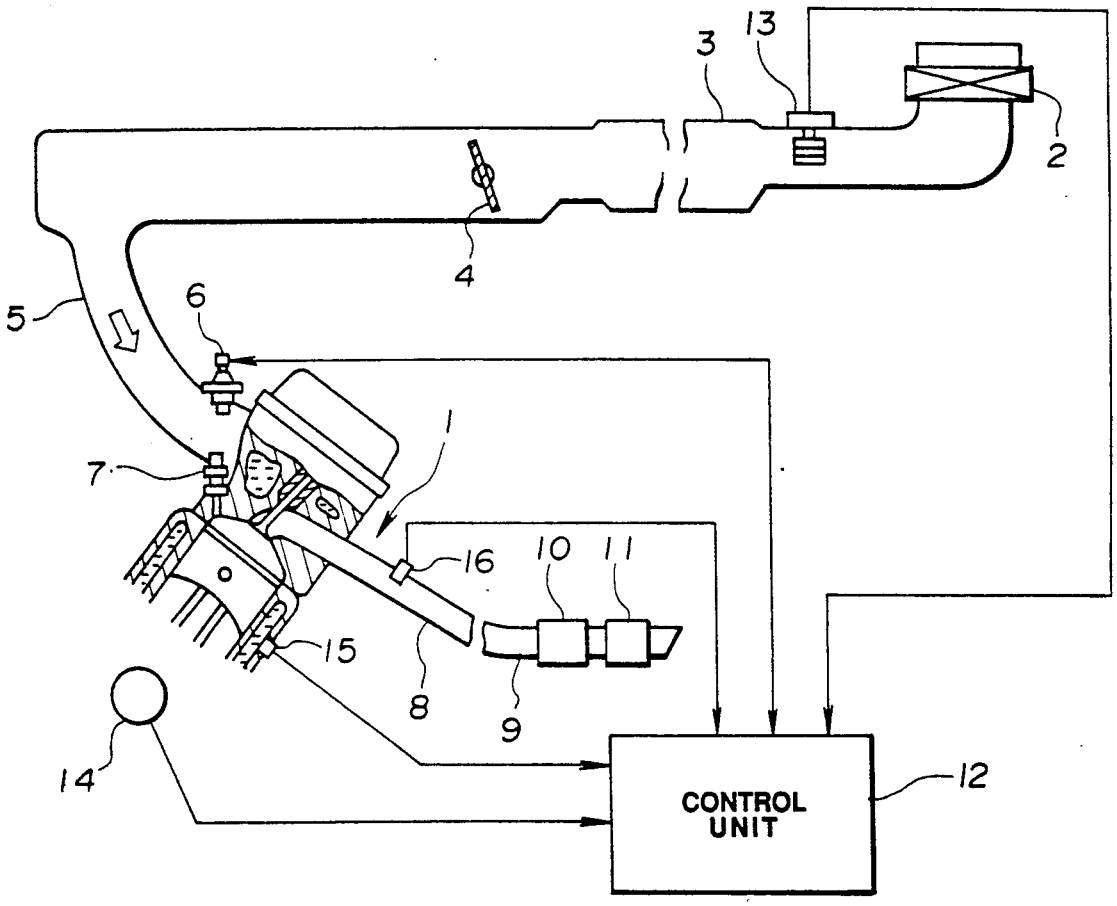
FIG. 1 is a circuit block diagram associated with a schematic view of an engine to which a self diagnosing apparatus of a fuel supply system of the engine according to the present invention is applicable.

FIG. 1 shows a circuit block diagram of a system for controlling a fuel supply quantity to which a self diagnosing apparatus and method therefor in a preferred embodiment according to the present invention is applied.

In FIG. 1, an internal combustion engine 1 sucks air from an air cleaner 2 via an intake air duct 3, throttle valve 4, and intake air manifold 5. A branched portion of the intake minifold 5 is provided with a fuel injection valve 6 for each engine cylinder. The fuel injection valve 6 opens its valve in response to an energization of its solenoid and closes its valve in response to a deenergization of its solenoid. A drive pulse signal from a control unit 12 causes its solenoid to be energized to open its valve so that a fuel whose pressure is adjusted to a predetermined value by means of a pressure regulator is injected therethrough. The fuel is supplied via a fuel pump (not shown) from a tank.

Each combustion chamber of the cylinders of the engine 1 is provided with an ignition plug 7 which serves to ignite and burn the supplied air/fuel mixture. An exhaust gas is exhausted from the engine 1 via an exhaust manifold 8, exhaust duct 9, three catalytic converter, and mufller 11.

The three catalytic converter 10 serves to convert (purify) exhaust gas harmful components such as NOx, CO, and HC into non-harmful exhaust gas components via oxidation and/or reduction process. Since it is necessary to control the air/fuel mixture ratio of the sucked air/fuel mixture toward a target air/fuel mixture ratio so as to obtain high convertibility in the oxidation and/or reduction process therein, the air/fuel mixture ratio feedback control is carried out, as will be described later. It is noted that a stoichiometric air/fuel mixture ratio is a target air/fuel mixture ratio toward which the actual air/fuel mixture ratio is controlled and approaches.

The control unit 12 generally includes a microcomputer having a CPU, ROM, RAM, A/D converter, and I/O interface.

The control unit 12 receives input sensor or switch signals from various types of sensors and switches, executes various calcuation processings and controls operations of the respective fuel injection valves 6 using drive signal(s).

The various types of sensors described above include an airflow meter 13 installed in the intake air duct 3 for detecting intake air quantity Q and outputting a signal indicative of the intake air quantity Q of the engine 1.

A crank angle sensor 14 is installed around an engine crankshaft. In the case of a four-cylinder engine, the crank angle sensor 14 outputs a reference signal REF whenever the crankshaft rotates 180 and a unit signal POS whenever the crankshaft rotates 1 or 2.

If the period of the reference signal REF, or the number of occurrences in the unit signal POS for a predetermined period of time is measured by the CPU to calculate the engine revolution speed N.

In addition, a water temperature sensor 15 is installed to detect a coolant temperature of the engine 1 flowing in a water jacket of the engine 1.

A collected portion of the exhaust manifold 8 is provided with an oxygen sensor 16 to detect the air/fuel mixture ratio. The oxygen sensor 16 serves to detect oxygen concentration in the exhaust gas so as to detect the air/fuel mixture ratio of the sucked air/fuel mixture.

The oxygen sensor 16 serves to monitor a rich state or lean state of the actual air/fuel mixture ratio with respect to the stoichiometric (target) air/fuel mixture ratio with the exhaust gas oxygen concentration abruptly changed between both sides of the stoichiometric air/fuel mixture ratio as a boundary.

The CPU of the microcomputer built in the control unit 12 carries out the arithmetic operation processing in accordance with the series of programme in the ROM shown in FIGS. 2 through 7.

That is to say, the CPU executes a setting of a fuel injection quantity Ti, executing a learning correction control of the air/fuel mixture ratio for each driving region and feedback correction control, controlling the fuel supply to the engine 1, and executing a self diagnose of the air/fuel mixture control state in the fuel supply control system.

Figure 2:
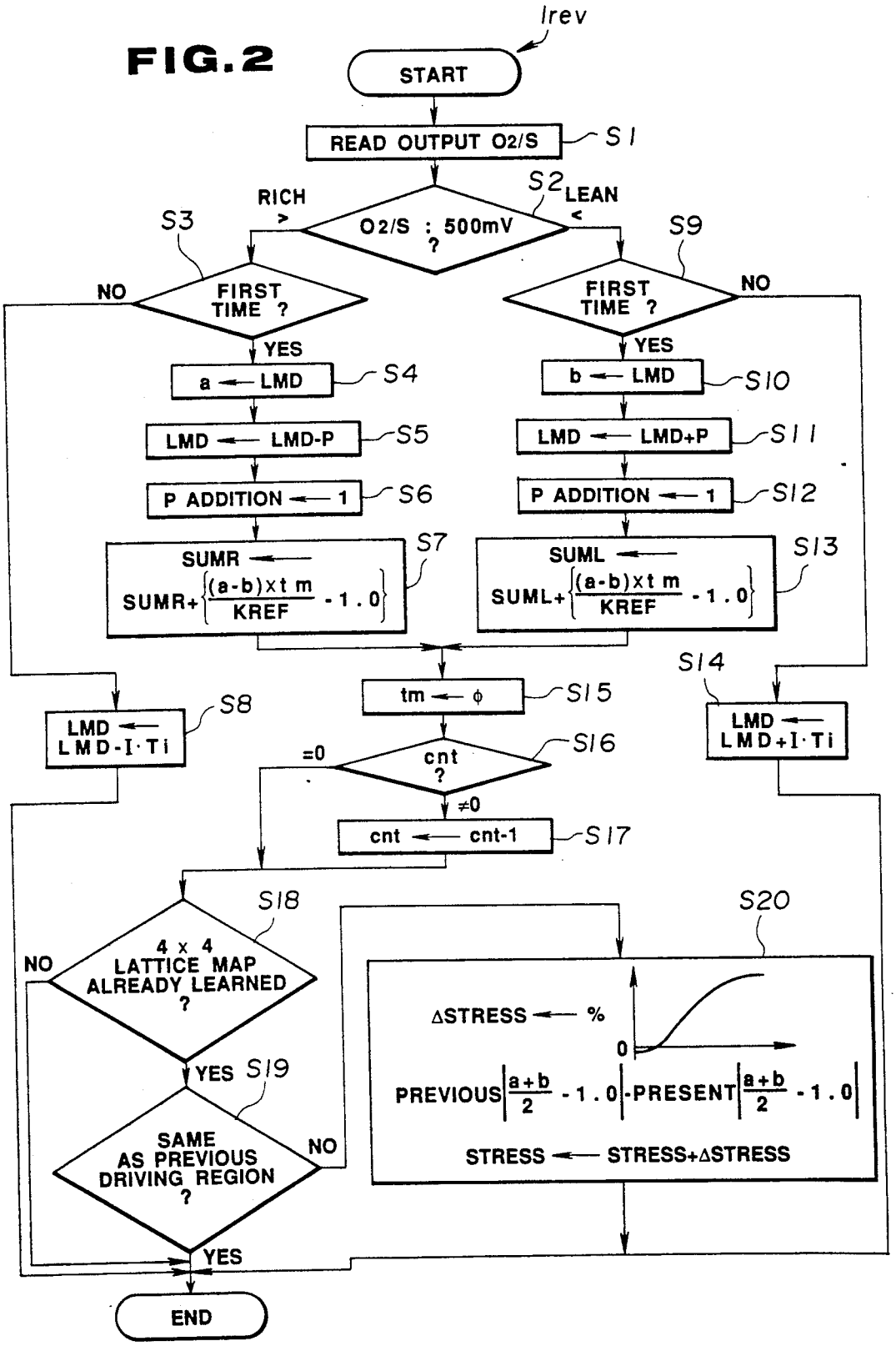
FIG. 2 is a program flowchart for executing set of an air/fuel mixture ratio feedback correction coefficient LMD in the fuel supply system shown in FIG. 1.

FIG. 2 shows a flowchart for setting an air/fuel mixture ratio feedback correction coefficient LMD (air/fuel mixture ratio feedback controlled variable) to be multiplied with a basic fuel injection quantity Tp ($\leftarrow K \times Q/N$; K denotes a constant) via proportion-integration control process.

The program shown in FIG. 2 is executed for one revolution (1 rev.) of the engine 1.

It is noted that the initial value of the air/fuel mixture ratio feedback correction coefficient LMD is 1 and the basic fuel injection quantity Tp is incremented or decremented so that the actual air/fuel mixture ratio approaches the target or stoichiometric air/fuel mixrture ratio. Consequently, the actual air/fuel mixture ratio is varied (or pulsatively fluctuated) about the target air/fuel mixture ratio as a center.

In a step S1, the CPU reads a voltage signal output from the oxygen sensor ($O_2$/S) 16 according to the oxygen concentration in the exhaust gas.

In a step S2, the CPU compares the voltage signal of the oxygen sensor 16 read in the step S1 with a slice (or threshold or boundary) level (for example, 500 mV) corresponding to the target air/fuel mixture ratio (stoichiometric air/fuel mixture ratio) so as to determine the actual air/fuel mixture supplied to the engine 1 depending on whether it indicates rich (richer of the fuel) or lean (leaner of the fuel) with respect to the target air/fuel mixture ratio.

When the voltage signal of the oxygen sensor 16 is higher than the slice level and the air/fuel mixture ratio is determined to be rich, the routine goes to a step S3 in which the CPU determines whether the present rich determination at the step S2 is the first time.

If the rich determination is the first time, the routine goes to a step S4 in which a value of an air/fuel mixture ratio feedback correction coefficient LMD previously set is set as a maximum value a.

The first rich determination means that the lean determination is previously made and, therefore, an incremental control of the air/fuel mixture ratio feedback correction coefficient LMD (=incremental correction of the fuel injection quantity Ti) has been carried out. Since when the rich determination causes, in turn, the correction coefficient LMD to be decremented, the value before the decremental control upon the first rich determination gives the maximum value of the correction coefficient LMD.

In the next step S5, then, a predetermined proportional constant P is subtracted from the previous correction coefficient LMD to carry out the decrease in the correction coefficient LMD so that the air/fuel mixture ratio becomes lean to approach to the target air/fuel mixture ratio.

In the next step S6, 1 is set to a flag (P Addition) which indicates that the proportional control has been executed.

Furthermore, in the next step S7, in the state where the actual air/fuel mixture ratio is lean with respect to the target air/fuel mixture ratio, a registered value of SUMR indicating a total sum of controlled variables by means of the air/fuel mixture ratio feedback correction coefficient LMD used to richen the air/fuel mixture ratio is updated and set in accordance with the following expression of arithmetic operation:

$$\mathrm{SUM}R \leftarrow \mathrm{SUM}R + \left\{ \frac{(a-b)\cdot tm}{KREF} - 1.0 \right\}$$

Figure 5:
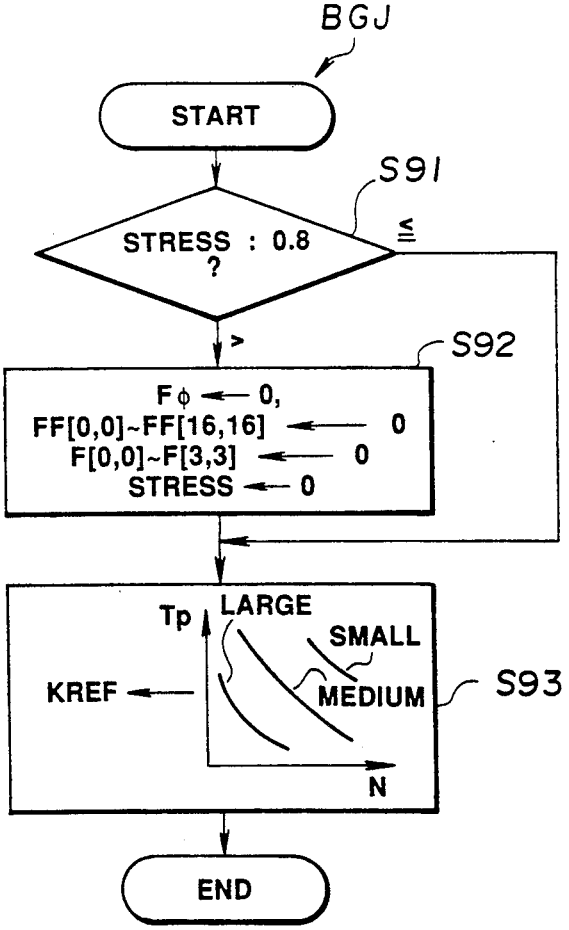
FIG. 5 is a program flowchart for executing a process on a basis of a parameter of [Stress] indicating a magnitude of inappropriateness of the learning correction value sampled in accordance with the series of flowcharts shown in FIGS. 3(A) through 3(C).

In the arithmetic operation described above, (a-b) denotes a width (or peak-to-peak length) of change in the correction coefficient LMD in order to richen the air/fuel mixture ratio in the previous air/fuel mixture ratio leaned state (magnitude in the change width of increment or decrement direction), tm denotes a time duration during which the air/fuel mixture ratio richened control is carried out in the previous air/fuel mixture ratio leaned state, and, furthermore, KREF denotes a correction coefficient set on the basis of the basic fuel injection quantity Tp (engine load) and engine revolution speed N as in a step S93 of the flowchart shown in FIG. 5.

That is to say, (a-b)×tm/KREF−1.0 denotes a value of a total quantity of the richened controlled variables derived from the air/fuel mixture ratio feedback correction coefficient LMD in the previous air/fuel mixture ratio lean state.

The total sum of the richened controlled variables is derived as a value of the change width (a-b) of the LMD multiplied by the richened control time duration tm and the corrected on the basis of the driving condition so as to be handled equally well even if the engine driving condition is different.

Then, when the latest total sum of the richened controlled variables is added to the total sum SUMR of the richened controlled variables previously derived so that the total sum SMUR of the richened controlled variables for a predetermined period of time can be derived.

On the other hand, when it is not the first time to determine the rich state (NO) in the step S3, the routine goes to a step S8 in which the correction coefficient LMD is updated by subtracting the value of the integration constant I multiplied by the latest fuel injection quantity Ti from the previous correction coefficient LMD. Then, until the richened state of the air/fuel mixture ratio is finished and it is reversed to the leaned state, the step S8 is repeatedly processed so that the air/fuel mixture ratio decemental integration control using the result of I×Ti is repeated whenever the program flowchart of FIG. 2 is ended.

In addition, when the actual air/fuel mixture ratio is determined to be lean with respect to the target air/fuel mixture (stoichiometric air/fuel mixture ratio) in the step S2, the routine goes to a step S9.

In the step S9, the CPU determines whether the present lean determination is the first time.

If it is the first time (YES) in the step S9, the routine goes to a step S10 in which, when it is the first time, the previous feedback correction coefficient LMD, i.e., the correction coefficient LMD which is gradually decreased during the rich determination is set to a minimum value b.

In the next step S11, the proportional constant P is added to the previous correction coefficient LMD so as to update the correction coefficient LMD, thus incementally correcting the fuel injection quantity Ti.

Furthermore, in the step S12, the flag (P Addtion) is set by 1, the flag indicating the execution of the proportional control in the same way as in the step S6.

In the next S13, the total sum SUML of the leaned controlled variable used to increment the actual air/fuel mixture ratio during the predetermined period of time in the same way as the step S7 is calculated in accordance with the following expression of arihtmetic operation:

$$\mathrm{SUM}L \leftarrow \mathrm{SUM}L + \left\{ \frac{(a-b)\cdot tm}{KREF} - 1.0 \right\}$$

On the other hand, when the lean determination in the step S9 is not the first time, the routine goes to a step S14 in which the value of the integration constant I multiplied by the latest fuel injection quantity Ti is added to the previous correction coefficient LMD so as to gradually increment the correction coefficient LMD.

When the proportional control of the correction coefficient LMD is executed at the first time of rich/lean determination, the routine goes to a step S15 in which the time tm indicating the control duration of time for richening or leaning the air/fuel mixture ratio is reset to zero.

Figure 4:
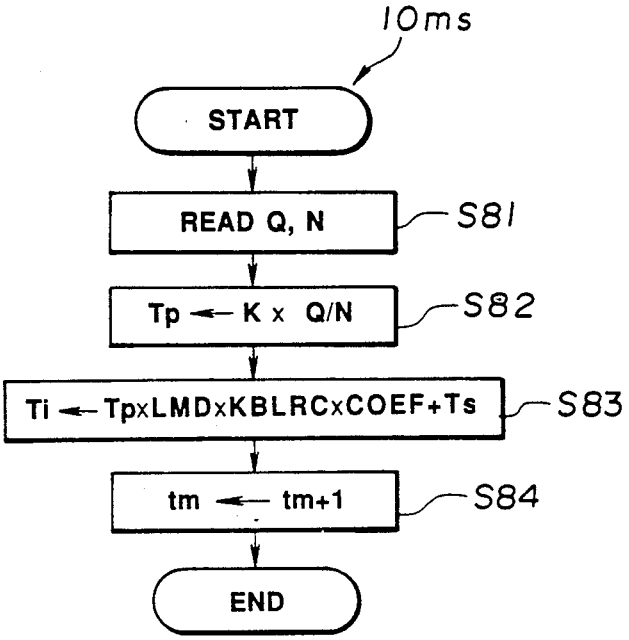
FIG. 4 is a program flowchart for executing a calculation and setting of a fuel injection quantity Ti to be supplied to the engine in the fuel supply system shown in FIG. 1.

The controlled time duration tm is incremented by one whenever the program flowchart in the step S84 of FIG. 4 is executed, i.e., whenever a predetermined minute time is passed. Consequently, the controlled time duration tm is reset to zero whenever the proportional control of the air/fuel mixture ratio feedback correction coefficient LMD is carried out. Until the next proportional control, the timer tm is counted up. A continuation time for the lean or rich control (proportional control period) is measured by means of the timer tm.

A series of processings on the learning and control over the air/fuel mixture ratio learning correction coefficients will be carried out subsequent to the step S16.

Figure 8:
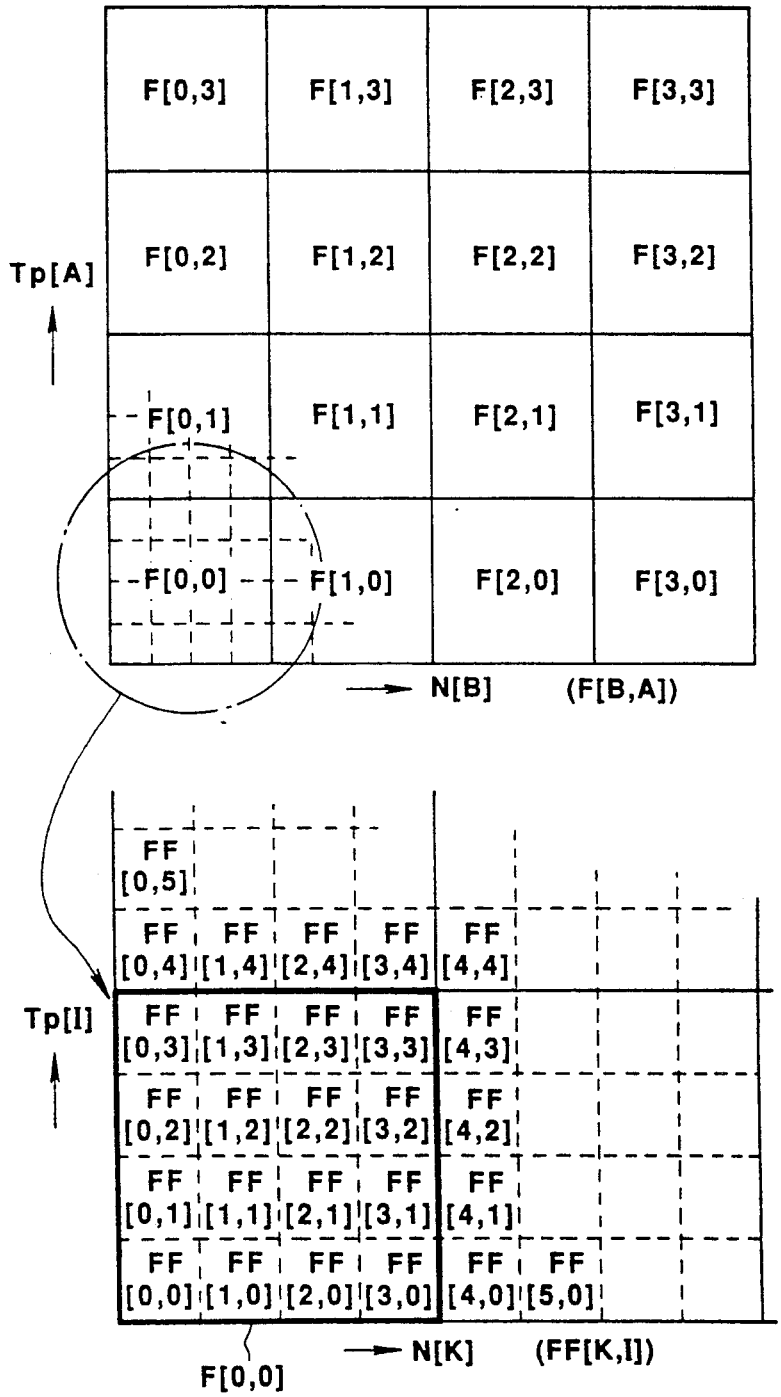
FIGS. 8 and 9 are virtual explanatory view of learning maps stored in a memory in the self diagnose apparatus shown in FIG. 1.

It is, however, noted that, in the preferred embodiment shown in FIG. 8, a whole driving region of the engine 1 is divided into a plurality of local (or unit) driving regions with the basic fuel injection quantity Tp and engine revolution speed N set as parameters, and two learning maps are provided rewritably storing the air/fuel mixture ratio learning correction value for each divided driving region. On one learning map, the whole driving region is divided into 16 semi-local driving regions by means of 4×4 lattices (or grids) and on the other learning map, the whole driving region is divided into 256 (or minor) local driving regions by means of 16×16 lattices.

As appreciated from FIG. 8, the single local driving region of the one learning map having 16 minor regions is subdivided into 4×4 semi-local driving regions.

It is noted that the air/fuel mixture ratio learning correction value fitted to the whole driving region not divided into the plurality of local driving regions is additionally learned and set.

Referring to FIG. 2, the CPU, at the step S16, determines whether a count value cnt indicating whether the present driving condtion derived on the basis of the basic fuel injection quantity Tp and engine revolution speed N falls in one of the 16 divided local driving regions and it is stably stopped therein is zero or not.

In details for the count value of cnt, in a flowchart of FIGS. 3(A) through 3(C) as will be described later, when the present engine driving condition to fall in any one of the local driving regions of 4×4 lattices is fluctuated or moved for a predetermined minute time among any other driving regions, the count value cnt is set to a predetermined value (for example, four). In a step S16, the CPU determines that the count value cnt is not zero and, thereafter, the routine goes to a step S17 in which the count value cnt is decremented by one. Since the count value cnt is decremented by one for each proportional control for the correction coefficient LMD since the present driving condition has fallen and stopped in one driving region. When the count value cnt is zero, the CPU can deem that the present engine driving condition has stably rested in one of the 4×4 local driving regions.

It is noted that the determination of whether the count value cnt is zero or not means a determination of whether the learning and updating of the learning correction coefficient KBLRC as will be described later should be carried out using the CPU. At an initial timing stage, when a changeover in any of the driving regions, no learning therefor is carried out.

In a step S18, the CPU determines whether almost all of the air/fuel mixture ratio learning correction values (KBLRC1) respectively corresponding to the divided driving regions on the learning map of 4×4 lattices are already learned.

When almost all driving regions on the 4×4 lattice learning map have been learned (YES), it is basically estimated that at each of all local driving regions the base air/fuel mixture is learned and controlled so as to approach to the target air/fuel mixture ratio. In this case at the step S18 (YES), the CPU determines whether the present engine driving condition continuously stops in one of the 16 local driving regions in the next step of a step S19.

Then, when, in the step 19, the CPU determines that the present engine driving condition does continuously not stop in one of the local driving regions on the 16 lattice map, in other words, when the corresponding driving region is fluctuated from one to any other driving region, the routine goes to a step S20.

In the step S20, a difference between an absolute value of the deviation previously derived and the absolute value of deviation of the latest correction coefficient LMD average value from a target convergence value (=1. 0) is derived as follows:

previous $|(a+b)/2-1.0|$ − present $|(a+b)/2-1.0|$.

A map of Δ Stress indicating a magnitude of inappropriateness to the learned value of KBLRC is referred to on the basis of a value of previous $|(a+b)/2-1.0|$ − present $|(a+b)/2-1.0|$.

In this addition, a map of ΔStrees is incrementally set as the variation of the average value of the correction coefficient LMD becomes large.

That is to say, since the learning on the learning map of 4×4 lattice learning map is substantially ended, the fluctuation in the base air/fuel mixture should be suppressed to a lower variation level so as to sufficiently follow a difference of required correction quantity to the basic fuel injection quantity Tp according to the change in the driving regions.

In a case where the variation in the base air/fuel mixture ratio due to a shift of the driving regions is large and a large compensative change in the air/fuel mixture ratio feedback correction coefficient LMD occurs so as to compensate for the variation in the base air/fuel mixture ratio, this indirectly indicates that the learned value is inappropriate.

ΔStress indicating the magnitude of inappropriateness of the learned value is set according to the variation level of the correction coefficient LMD.

Furthermore, Δ Stress is accumulated and the accumulated result is stored as Stress.

It is noted that, as will be described later, when the Stress exceeds a predetermined value, the CPU determines whether the learned air/fuel mixture ratio learning correction coefficient (KBLRC) is appropriate and the learning thereof is again resumed.

Figure 3A:
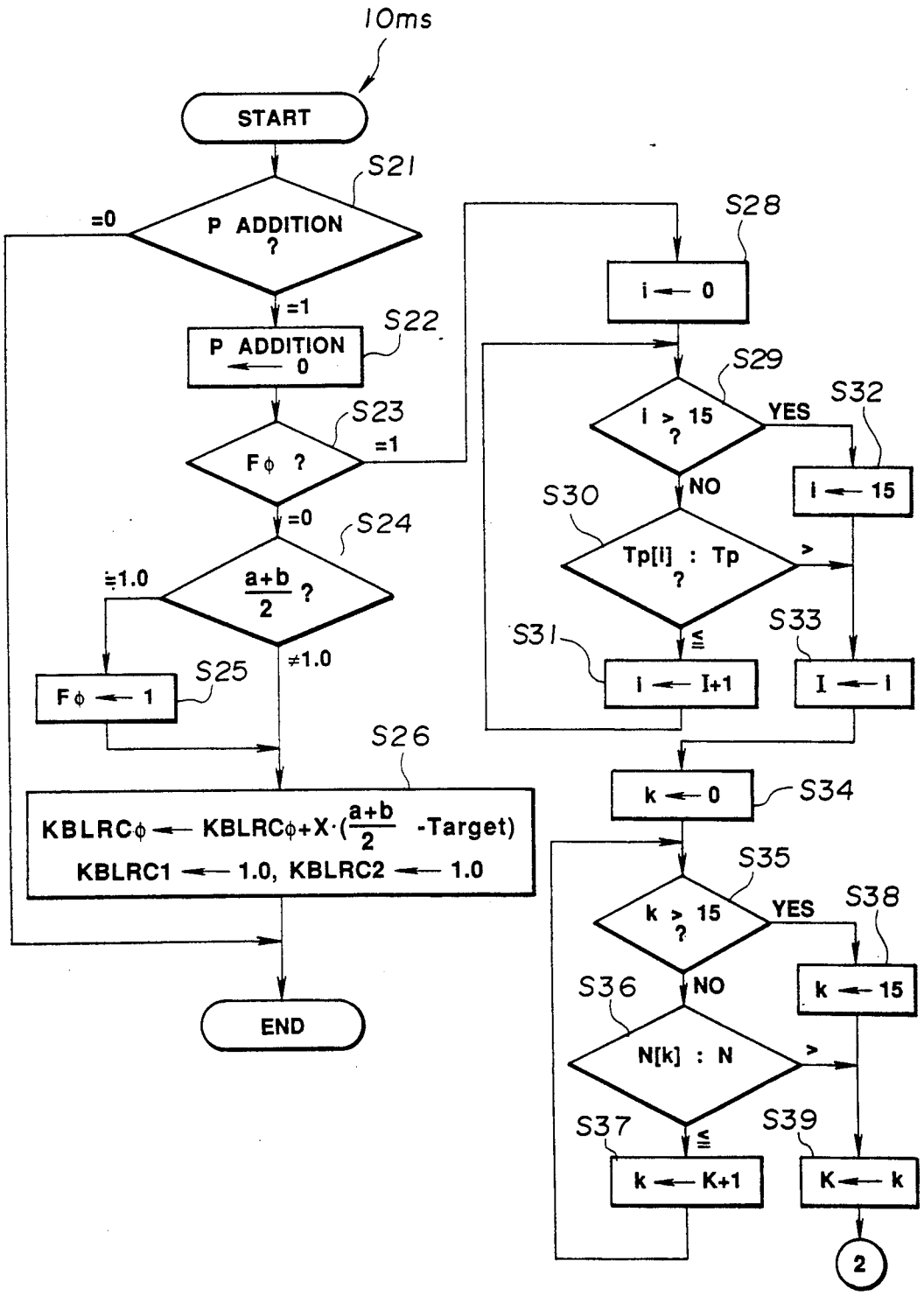
FIGS. 3(A), 3(B), and 3(C) are programr33 flowcharts for executing learning of the air/fuel mixture ratio according to respective driving regions in the fuel supply system shown in FIG. 1.
Figure 3B:
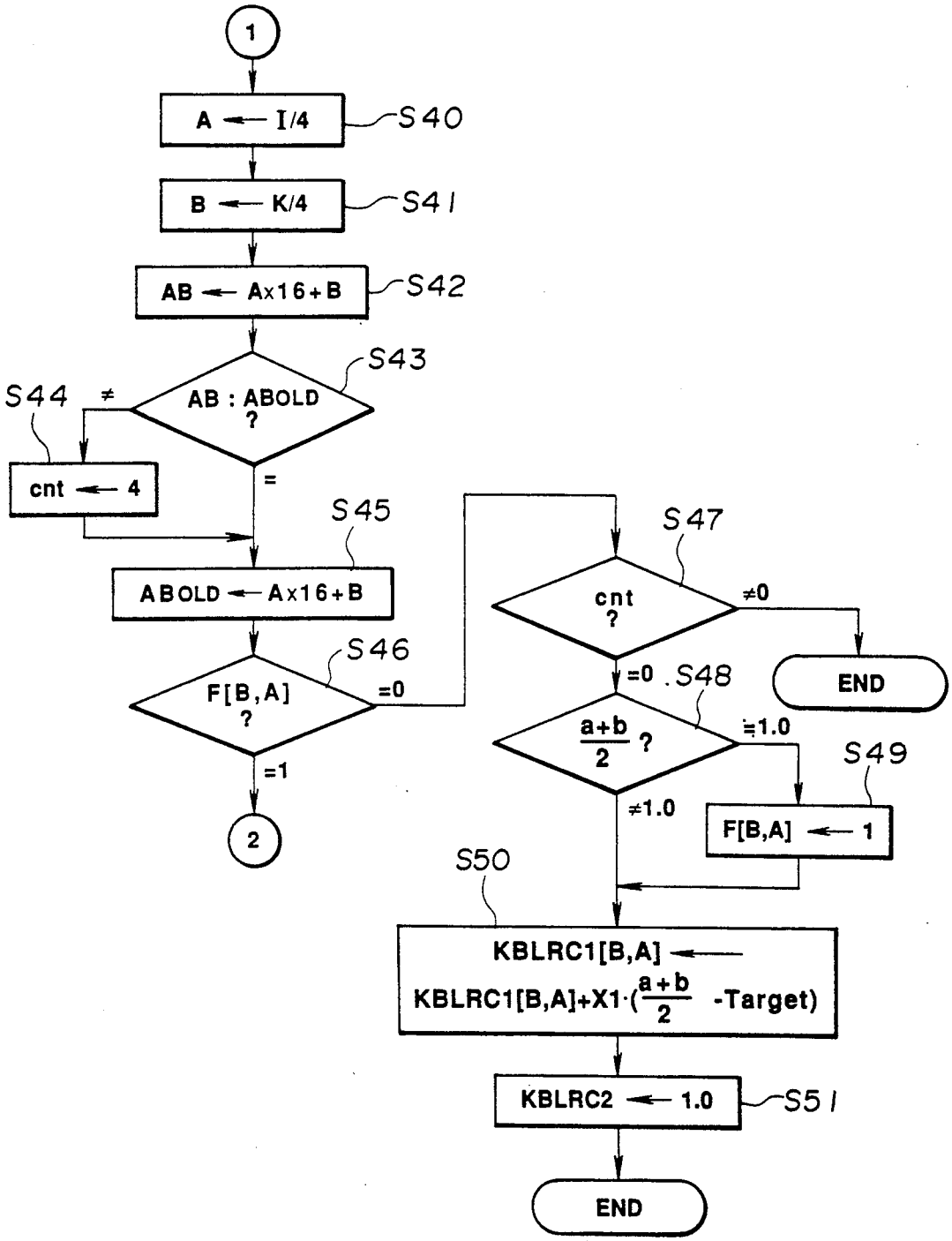
Figure 3C:
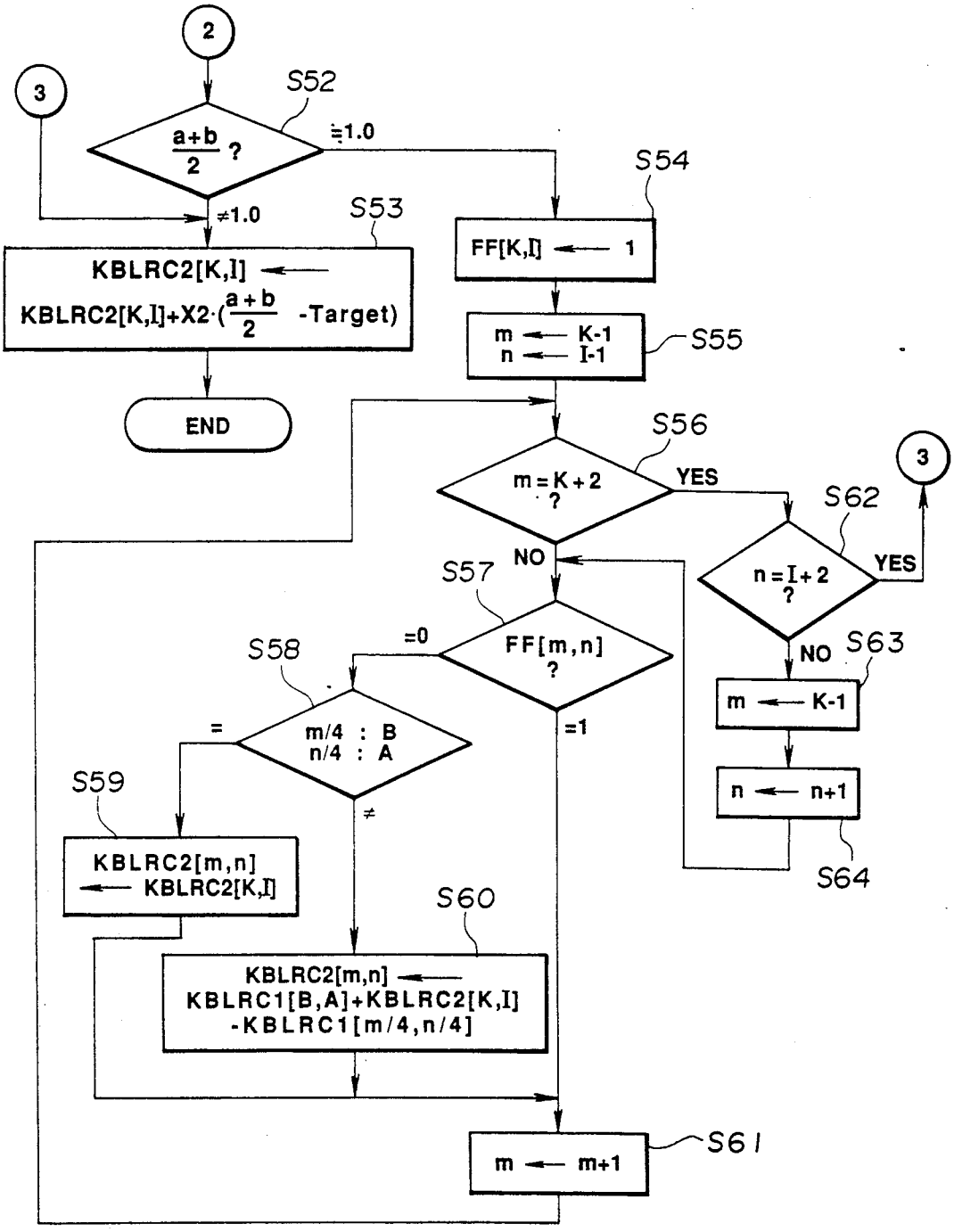

Next, FIGS. 3(A) through 3(C) show integrally the flowchart for learning the learning correction coefficients (KBLRC0, KBLRC1, KBLRC2) respectively at the divided driving regions.

Referring to FIG. 3(A), at a step S21, the CPU determines whether the flag (Addition P) which is set to 1 when the proportional control of the air/fuel mixture ratio feedback correction coefficient LMD is carried out in the flowchart of FIG. 2 is 1 or not. If the flag (Addition P) is 1, the routine goes to a step S22 in which the flag (Addition P) is reset to zero. Thereafter, various processings after the step S22 are executed. If the flag (Addition P) is zero, the present program flow is ended.

After the flag (Addition P) is reset to zero in the step S22, the CPU determines wether a flag F0 indicating whether a first learning correction coefficient KBLRC0 (initial value is 1) which applies to an air/fuel mixture ratio learning correction value common to the whole driving region has been learned is set to 1 or not.

It is noted that when the flag F0 indicates zero and, therefore, the CPU determines that the learning of the learning correction coefficient KBLRC0 is not yet ended, the routine goes to a step S24 in which the CPU determines whether an average value of the maximum value and minimum value a, b of the correction coefficient LMD is substantially 1 (←(a+b)/2).

If (a+b)/2 is not substantially 1 (≠1), the routine goes to a step S26 in which the predetermined coefficient X is multiplied by the value of the target convergence value Target of the correction coefficient LMD (in the preferred embodiment, the initial value of 1.0) subtracted from (a+b)/2 and the result of subtraction is added to the previous learning correction coefficient KBLRC0 and the result of addition is set as the new learning correction coefficient KBLRC0 as follows:

$$KBLRC0 \leftarrow KBLRC0 + X \cdot \left( \frac{a+b}{2} - \text{Target} \right)$$

In addition, in the step S26, 1.0, i.e., the initial value is set to each of the second learning correction coefficients KBLRC1 and third learning correction coefficients KBLRC2 stored respectively in the respective driving regions on the 4×4 lattice map and in those on 16×16 lattice map so as to be in the initialized state.

Hence, when the learning correction coefficient KBLRC0 is newly updated, the data on the learned values are reset to the inital value and, thereafter, the learning from the learning correction coefficient KBLRC0 is started even when the learned values of KBLRC1 and KBLRC2 are stored in the 4×4 lattice map and 16×16 lattice map, respectively.

When, in the step S24, the CPU determines that the value of (a+b)/2 substantially equals 1, the routine goes to a step S25 in which the flag F0 is set to 1.

In other words, as the result of learning and updating of the first learning correction coefficient KBLRC0, the CPU can determine that the air/fuel mixture ratio feedback correction coefficient LMD is converged at 1.

On the other hand, in a case where the flag F0 indicates 1 at the step S23, the CPU can determine that the learning of the first learning correction coefficient KBLRCO corresponding to the whole driving region has been ended. Therefore, the learning on the air/fuel mixture ratio for each driving region divided in plural is, in turn, carried out on the basis of the present basic fuel injection quantity Tp and engine revolution speed N using the respective learning maps.

First, the CPU specifies the corresponding driving region to which the present driving condition determined from the Tp and N corresponds on the 16×16 lattice learning map.

That is to say, in a step S28, the CPU sets a counter value i to zero, the counter value i being referred to so as to determine to which longitudinal order number of the local driving regions the present basic fuel injection quantity Tp is included (refer to FIG. 8).

In the next step S29, the CPU determines whether the count value i exceeds 15. When the count value i does not exceed 15, the routine goes to a step S30 in which a threshold value Tp [i] of the basic fuel injection quantity Tp corresponding to the count value i is compared with the latest (newest) calculated basic fuel injection quantity Tp.

When the latest basic fuel injection quantity Tp is less than the threshold value Tp [i], the routine goes to a step S33 in which the present count value i is set to I as the corresponding region position on one of the longitudinal 16 lattices. That is to say, with the maximum basic fuel injection quantity Tp for each driving region set previously as the threshold value Tp [i], the latest basic fuel injection quantity Tp is sequentially compared with the threshold value Tp [i] in the order from less (a least value) threshold value. The count value i at a time at which Tp [i]>Tp is first satisfied indicates the lattice position of corresponding Tp block and the count value i of its arrival time is set to I in the step S33.

In addition, when Tp [i]≦Tp, the routine goes to a step S31 in which the count value i is incremented by one. Furthermore, the CPU compares the further one-step larger threshold value Tp [i] with the latest Tp.

Then, if the count value i is counted up to 16, it indicates that the basic fuel injection quantity Tp which is larger than the maximum value of initial setting over the range of the basic fuel injection quantity Tp divided into 16 lattices from 0 to 15 is calculated.

At this time, 15 is set to i in the step S32 and the routine goes to a step S33 in which the present Tp is included in the maximum Tp region of the Tp block initially set.

Next, due to the lateral division of 16 blocks according to the engine revolution speed N, the block position including the latest engine revolution speed N is determined as a count value of k. First, in a step S34, zero is initially set to the count value k.

Until the count value k is determined to exceed 15 in the step S35, the latest engine revolution speed N is sequentially compared with the threshold N [k] at the step S36.

The count value k at the first time when N [k]>N is set to K indicating the corresponding position of the N block. If N(k)≦N, the routine goes to the step S37 in which the count value k is incremented by one. In addition, when the count value k exceeds 15, the routine goes to a step S38 in which the maximum value 15 is set to the count value k and the routine goes to a step S39.

In this way, in which driving region of the learning map divided into 256 local driving regions the present engine driving condition is included, with the basic fuel injection quantity Tp and engine revolution speed N as parameters, is indicated by an orthogonal coordiate position [K, I] represented by the block position I of Tp and block position of I.

If the corresponding position of 16×16 lattices is determined, the position of the 4×4 lattice learning map in which the present driving condition falls can be specified on the basis of the above-described coordinate position I, K.

That is to say, referring to FIG. 3(B), in a step 40, the block number I of the Tp is divided by four and a result of division of the value of integer, with the decimal fractions omitted therefrom, is set to A (A←I/4).

In addition, in a step S41, the block number K of N blocks is similarly divided by four and the result of division of a value of integer, whose decimal fractions are omitted, is set to B (B←K/4). Thus, the region position on the 4×4 lattice map corresponding to the present driving condition is represented by [B, A].

In the next step S42, [B, A] indicating the corresponding region position on the 4×4 lattice map is used. In order to determine whether the corresponding driving region on the 4×4 lattice map is varied, the result of addition of A multiplied by 16 to B and its result of addition is set to AB (AB←A×16+B).

Then, in a step S42, $AB_{OLD}$ is compared with the latest AB, i.e., the CPU determines whether the presently corresponding region on the 4×4 lattice map is the same as the previous one. If $AB \neq AB_{OLD}$ and the presently corresponding area is different from the previous one, a predetermined value (for example, four) is set to the count value cnt in a step S44.

In a step S45, the value AB calculated in the step S42 is set to $AB_{OLD}$ as the previous value in order to execute the process in the step S43 at the subsequently repeated routine.

In a step S46, a flag F [B, A] is used to determine whether the air/fuel mixture ratio learning is ended at the driving region indicated as the coordinate system of [B, A] on the 4×4 lattice map and including the present engine driving condition. When the flag F [B, A] indicates zero and the learning at one of the driving regions on the 4×4 lattice map included in the present driving condition is not ended, the routine goes to a step S47.

In a step S47, the CPU determines whether the count value cnt is zero or not. If not zero and the variation (or changeover) from the corresponding region to another driving region on the 4×4 lattice map is present, the program is ended. If the count value cnt is zero so as to indicate that only the engine driving condition stably settles in the corresponding driving region, the routine goes to a step S48.

In a step S48, the CPU determines the degree of advance on the learning of KBLRC depending on whether an average value (a+b)/2 of maximum and minimum values a, b of the air/fuel mixture ratio feedback correction value LMD sampled at the flowchart of FIG. 2, i.e., the center value of the correction coefficient LMD is placed in the vicinity to the initial value (=1) which is the target convergence value of the correction coefficient LMD. Then, if the learning is not ended, the routine goes to a step S50.

In a step S50, the CPU adds a value of the target convergence value Target (in the preferred embodiment, 1.0) subtracted from the average value of the maximum and minimum values a, b with respect to the second learning correction coefficient KBLRC1 correspondingly stored to the present region of [B, A] in the 4×4 lattice map to a value multiplied by a predetermined coefficient X1.

The result is newly updated as the learning correction coefficient KBLRC1 corresponding to the present driving region on the 4×4 lattice map.

$$KBLRC1 \leftarrow KBLRC1 + X1\{(a+b)/2\text{-}Target\}$$

If, in the step S48, (a+b)/2≈1 and the learning at the driving region on the 4×4 lattice map included in the present driving condition is ended, 1 is set to the flag F [B, A] in a step S49 so that the CPU determines that any driving resion corresponding to the set of the flag F [B, A] to 1 has already been learned.

During the learning at the region [B, A] on the 4×4 lattice map, for the learning correction coefficients KBLRC2 at the 4×4=16 regions included in [B, A] of the 16×16 lattice map, in a step S51, these are all reset to the initial value 1. 0.

In this way, when any one of the 4×4 lattice regions is present at which the learning of KBLRC1 is not ended, a predetermined rate of the deviation of (a+b)/2 from the target value Target is added to previously stored learning correction coefficient KBLRC1 to updata the learning correction coefficient KBLRC1. Then, the target air/fuel mixture ratio is achieved by the correction of Tp by the learning correction coefficient KBLRC1 in place of the air/fuel mixture ratio feedback correction coefficient LMD.

When the air/fuel mixture ratio feed back correction value LMD is substantially converged into the initial value 1 which is the target convergence value, the learning at the driving region can be deemed to be ended.

On the other hand, when, in the step S46, the CPU determines that the flag F [B, A] indicates 1 and that the already learned learning correction coefficient KBLRC1 is stored at the presently corresponding driving region on the 4×4 lattice map, the routine goes to a step S52.

After the step S52, the present driving region [B, A] on the 4×4 lattice map in which the learning correction coefficient KBLRC1 is stored is transferred to the learning at the corresponding subdivided drioving regions of the 16×16 lattice learning map.

That is to say, at the step S52, the CPU determines whether (a+b)/2 which is an average value of the correction coefficient LMD is substantially coincident with 1 of the target convergence value.

If (a+b)/2≠1 and it is unlearning state which requires the correction by means of the air/fuel feedback correction coefficient LMD, the routine goes to a step S53.

In the step S53, the CPU adds the value of the target convergence value Target (in the preferred embodiment, 1. 0) subtracted from (a+b)/2 and multiplied by the predetermined coefficient X2 to the previously stored learning correction coefficient KBLRC2 [K, I] corresponding to the driving region [K, I] including the present driving condition on the 16×16 lattice learning map.

The result of addtion is updated as a new correction coefficient KBLRC2 [K, I] at the corresponding driving region position [K, I].

KBLRC2 [K, I]←KBLRC2 [K, I]+X2{(a+b)/2-Target}.

On the other hand, when the CPU, at the step S48, determines that the average value of the correction coefficient LMD; (a+b)/2 is substantially coincident with 1 of the target convergence value Target, the routine goes to a step S54.

In the step S54, 1 is set to a flag FF [K, I] for the CPU to determine that the learning of KBLRC2 at the driving region position [K, I] including the present driving condition on the 16×16 lattice learning map is ended.

Then, in the processing routine after the step S55, on the basis of the predetermined driving region position [K, I] on the 16×16 lattice learning map for which the flag [K, I] is set to 1, the CPU carries out such a control procedure that the same learned value as the third learning correction coefficient KBLRC2 stored in the present driving region position [K, I] on the 16×16 lattice learning map is used to update and store it in the unleaned driving regions of the 16×16 lattice learning map in a case where any other of the driving regions which are adjacent to the predetermined driving region position [K, I] and at which the learning of KBLRC2 are not ended are present.

In a step S55, that is to say, each value of [K, I] indicating the region position including the present driving condition on the 16×16 learning map is subtracted by one and is set to m, n (m←K−1, n←I−1).

In the next step S56, the CPU determines whether m=K+2.

When the routine goes to the step S56 from the step S56, the CPU determines NO determination in the step S56. In the step S57, the CPU determines whether the learning of one driving region of 16×16 lattices indicated by [m, n] is ended or not according to whether a flag FF [m, n] is 1 or 0.

When the learning thereof is not ended, the flag FF [m, n] indicating zero, the routine goes to a step S58.

In the step S58, the CPU converts the region adress [m, n] on the 16×16 lattice learning map into the region [m/4, n/4] on the 4×4 lattice map to determine whether the converted region address [m/4, n/4] on the 4×4 lattice map coincides with the region [B, A] on the 4×4 lattice map.

That is to say, although [K, I] is one of the regions included in [B, A], one of the other regions surrounding the one [K, I] may be included in another region adjacent to [B, A] on the 4×4 lattice map.

If it is included in the same driving region [B, A] ([m/4, n/4]=[B, A]), the routine goes to a step S59 in which the learning correction coefficient KBLRC2 corresponding to the area [K, I] determined to be presently learned directly serves as the learned value at the region [m, n].

On the other hand, at the step S58, when the region [m, n] adjacent to [K, I] is determined to be included in one of the different driving regions on the 4×4 learning map, the routine goes to a step S60.

The learning correction coefficient KBLRC2 calculated in the following equation is stored in the region [m, n] in the step S60.

$$KBLRC2\,[m, n] \leftarrow KBLRC1\,[B, A] + KBLRC2\,[K, I] - KBLRC1\,[m/4, n/4].$$

Since the arithmetic operation equation deriving KBLRC2 [m, n] described above is based on such an estimation that since the region positions [K, I] and [m, n] are regions mutually adjacent on 16×16 lattice maps, a final request for correction should have approximated. Since the learning correction coefficients KBLRC1 on the 4×4 lattice map are difference from each other, a total of KBLRC1 [B, A], KBLRC1 [m/4, n/4] may be appropriated as denoted by the following equation.

$$KBLRC[B.A]+KBLRC2[K.I]=KBLRC1[m/4.n/4]-KBLRC2[m.n]$$

When the region [m, n] is already learned region as described above, it is not necessary to update the learned value.

In addition, if the learned value is not yet learned, KBLRC2 [m, n] on the basis of KBLRC2 [K, I] is updated and set, the routine goes to a step S61.

In the step S61, m is incremented by one and the routine is again returned to the step S56.

Thereafter, the CPU determines whether the learning or non-learning is present for each driving region by moving m in a range of ±1 with K as a center and n constant until m=K+2.

Then, when the CPU determines that m=K+2 in the step S56 as the result of one incremental process of m at the step S61, the routine, in turn goes to a step 62 in which the CPU determines whether n=I+2.

If n≠I+2, the routine goes to a step S63 in which m is again set to K−1.

In the next step S64, n is incremented by one and, thereafter, the routine goes to a step S57.

Then, when as the result of one incremental process of m in the step S61, the CPU determines that m=K+2, the routine, in turn, goes to a step S62 in which the CPU determines whether n=I+2.

If n≠I+2, the routine goes to a step S63 in which the CPU sets again m to K−1. In the next step S64, the CPU increments n by one and thereafter the routine goes to a step S57.

Hence, if first n=I−1 and m is moved in the range of ±1 with K as the center to carry out the determination of learning at the adjacent regions.

Figure 9:
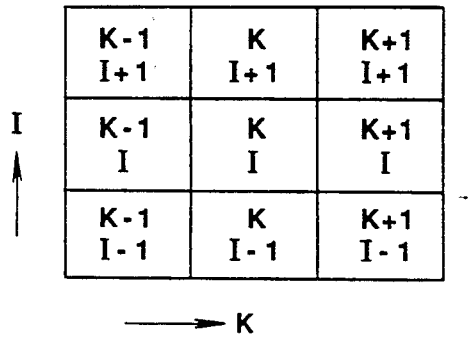

Next, when, if n=I and m is moved in the range of ±1 with K as the center, and, next, if n=I+1 and m is moved with K as the center, eight driving regions surrounding [K, I] are not learned (refer to FIG. 9), the value based on the learning correction coefficient KBLRC2 [K, I] is stored as the learning correction coefficient KBLRC2 [m, n] for the corresponding driving region.

In this way, when the result of learning of the learned region is applied equally well to the adjacent non-learning regions, an occurrence of large stepwise difference in the controllability of the air/fuel mixture ratio between the adjacent driving regions can be prevented even though an opportunity of learning for each driving region is rare due to the subdivision of the learning map of 16×16 lattices by 16×16 local driving regions.

When, in the step S62, the CPU determines that n=I+2, all determination processings for the eight driving regions surrounding [K, I] have been ended. Therefore, at this time, the routine goes to a step S53 in which the learning and updating of the learning correction coefficient KBLRC2 for which the learning is already carried out at the present region [K, I] and the further improvement of learning accuracy is achieved.

In this way, in the preferred embodiment, at first, after the learning correction coefficient KBLRC0 corresponding to all driving regions is learned, the learning for respective driving regions divided according to the learning maps of 4×4 lattices is carried out. Furthermore, since the learning is carried out for 4×4 lattice, the learning is advanced from the large driving region to the smaller driving region. The convergence characteristic of the air/fuel mixture ratio by means of the learning at the large driving region can be assured. If the learning is advanced, the learning for finer driving region is carried out.

The difference in the required correction value due to the difference in the driving region can accurately be responded.

Figure 6:
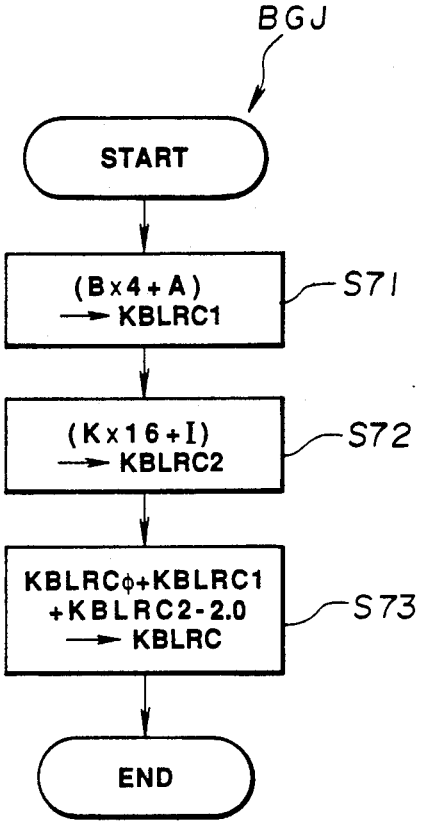
FIG. 6 is a program flowchart for executing the set of the learning correction coefficient KBLRC.

The setting of the final air/fuel mixture ratio learning correction coefficient KBLRC based on three learning correction coefficients KBLRC0, KBLRC1, and KBLRC2 is carried out in accordance with the flowchart of FIG. 6.

The flowchart of FIG. 6 is processed as a background job.

First, in a step S71, the CPU reads the learning correction coefficient KBLRC1 stored in the region [B, A] of the 4×4 lattice map.

In the next step S72, the CPU reads the learning correction coefficient KBLRC2 stored in the region [K, I] of 16×16 lattice map.

It is noted that B×4+A and K×16+I shown in the flowchart of FIG. 6 are converted from the addresses indicating their lattice positions into the memory addresses.

In a step S73, the final learning correction coefficient KBLRC is set as KBLRC0+KBLRC1+KBLRC2-2.0→KBLRC.

The learning correction coefficient KBLRC set in the flowchart of FIG. 6 is used to set arithmetically the fuel injection quantity Ti in the program flowchart of FIG. 6.

The learning correction coefficient KBLRC set in the flowchart of FIG. 6 is used to arithmetically set the fuel injection quantity Ti in the program of FIG. 4.

The program of the flowchart of FIG. 4 is executed for each predetermined minute time (for example, 10 ms).

In a step S81, the CPU receives the intake air quantity Q detected by the airflow meter 1 and engine revolution speed N detected on the basis of the detection signal from the crank angle sensor 14.

In the next step S82, the CPU calculates the basic fuel injection quantity Tp (←K×Q/N: K denotes a constant) corresponding to the sucked airflow quantity Q per unit revolution on the basis of the input intake air quanitity Q and engine revolution speed N input in the step S82.

In the next step S83, the CPU calculates the final fuel injection quantity (fuel supply quantity) Ti with correction of the basic fuel injection quantity Tp calculated in the step S82.

The correction value used in the correction of the basic fuel injection quantity Tp is learned and set for the respective driving regions in accordance with the flowchart of FIGS. 3(A) through 3(C), the learning correction coefficient KBLRC finally set in the flowchart of FIG. 4, the air/fuel mixture ratio feedback correction coefficient LMD calculated in accordance with the flowchart of FIG. 3, various types of correction coefficients COEF set so as to include a basic correction coefficient based on a coolant water temperature Tw detected by the water temperature sensor 15 and including the incremental correction coefficients after the engine cranking, and correction parts Ts so as to correct the change in an effective injection time interval of the fuel injection valve 6 according to the change in battery voltage.

$$Ti \leftarrow Tp \times LMD \times KBLRC \times COEF + Ts$$

The final fuel injection quantity Ti thus derived is updated whenever a predetermiend time has passed.

The control unit 12, when the time has arrived at the predetermined fuel injection timing, outputs the drive pulse signal having a pulsewidth corresponding to the fuel injection quantity Ti latestly calculated in accordance with the program shown in FIG. 4 and controls the fuel supply quantity to the engine 1.

Furthermore, in a step S84, the CPU increments tm by one, the value of timer Tm being used to count the richened or leaned control time duration in the flowchart of FIG. 3.

The program shown in the flowchart of FIG. 3(A) is a program carried out on the basis of [Stress] indicating a magnitude of inappropriateness of the learned correction value sampled in accordance with the flowchart of FIG. 2 and executed as a BACKGROUND JOB (BGJ).

In a step S91, the CPU compares the stress (magnitude of deviation of the air/fuel mixture ratio) accumulated in the step S20 of the flowchart of FIGS. 3(A) through 3(C) with a predetermined value (for example, 0.8) so as to determine whether the magnitude of the air/fuel mixture ratio deviation at the time when the learning is almost ended is above the predetermined value.

If the Stress exceeds the predetermined value, the CPU determines that although the learning is almost ended, the result of learning is inappropriate and the deviation of the air/fuel mixture ratio occurs.

The routine goes to a step S92 in order to make the learning again (relearning).

In a step S92, the CPU resets all of the flags F0, F [0, 0]~F [3, 3], FF [0, 0]~FF [16, 16], starts the learning from the learning correction coefficient KBLRC0 corresponding to all driving regions, and resets the Stress to zero.

In this way, if the magnitude of deviation (Stress) of the air/fuel mixture ratio feedback correction coefficient LMD with respect to the reference value LMD exceeds the predetermined value, the learning is again executed. Therefore, if such an accident as opening a hole in the intake air system causes the abrupt change in the air/fuel mixture ratio, the learning for each large driving region is again carried out so that the air/fuel mixture ratio can speedily be converged.

Figure 7:
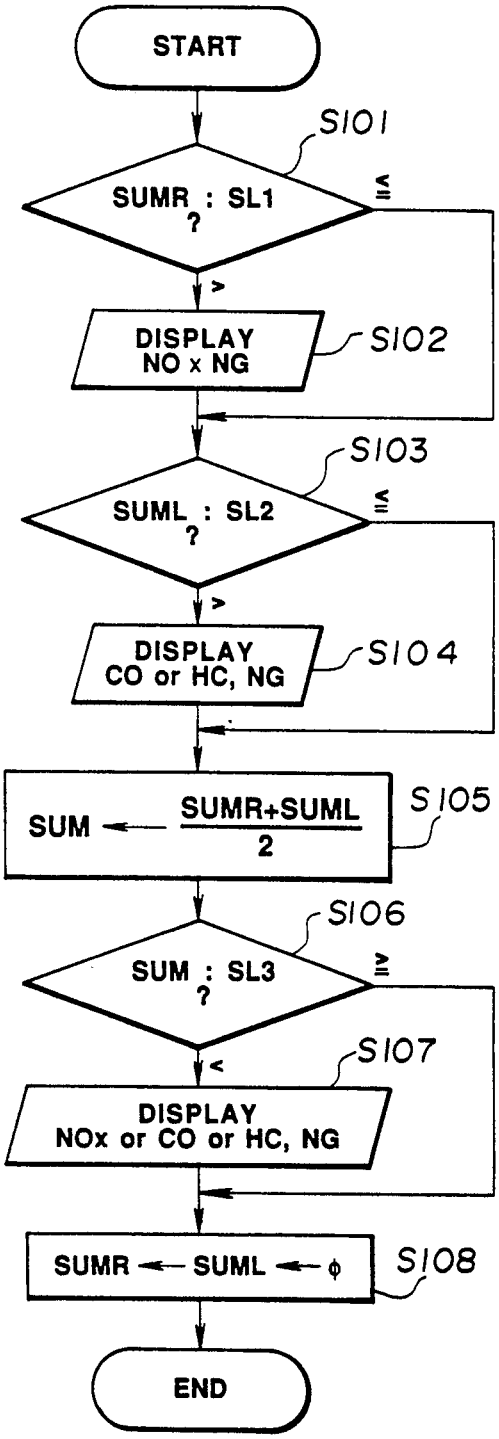
FIG. 7 is a program flowchart for executing a self diagnose for the fuel supply system shown in FIG. 1.

Next, FIG. 7 shows a program flowchart of a self diagnose for the electronically controlled fuel injection system on the basis of a sum SUMR of the richened controlled variable and sum SUML of the leaned controlled variable SUML within the predetermined period of time (five minutes as in the preferred embodiment) derived in the flowchart of FIG. 2.

The self diagnose program shown in the flowchart of FIG. 7 is executed for a predetermined interval of time (for example, five minutes).

In a step S101, the CPU compares the total sum SUMR of the richened controlled variable set in the step S7 of the flowchart of FIG. 2 and the threshold value SL1 set to determine the richened controlled variable.

It is noted that the total sum SUMR of the richened controlled variable which exceeds the threshold level SL1 means the execution of the larger or incremental control for a longer duration of time than the usual. In this case, some inconvenience, for example, parts deterioration, failure, deviations of yields of the products and due to insufficient advance of the air/fuel mixture ratio learning cause the air/fuel mixture ratio to be deviated toward the leaned state with respect to the target air/fuel mixture ratio. It is estimated that the large richened control is needed. It is also estimated that the leaned tendency of the air/fuel mixture ratio increases the concentration of NOx.

If SUMR > SL1, the routine goes to a step S102. The worsening of controllability of the air/fuel mixture ratio in which the air/fuel mixture ratio is deviated largely at the lean side tends to increase the concentration of NOx in the exhaust gas. This is used to alert the driver through an indicating or display instrument installed in the vicinity to the driver's seat.

On the other hand, if the total sum SUMR of the richened controlled variable is determined to be below the threshold value SL1 in the step S101, the CPU deems that the leaned air/fuel mixture ratio is at least not extraordinarily largely generated.

The routine goes to a step S103 via a step S102.

In a step S103, the CPU compares the total sum SUML of the richened controlled variable setin the step S13 of the flowchart of FIG. 2 and the threshold value SL2 set for the determination of the leaned controlled variable.

It is noted that the total sum SUML of the leaned controlled variable which exceeds the threshold value SL2 indicates that the correction coefficient LMD is decrementally controlled which is larger or it takes for a longer period of time.

In this case, some inconvenience, such as parts deterioration, failures, variations in products, and, furthermore, due to the insufficient advance of the air/fuel mixture ratio learning, the air/fuel mixture ratio is largely deviated toward the richer direction.

It is estimated that the large lean control is necessary. The richened tendency of the air/fuel mixture ratio can estimate the increase in CO, HC concentration as the exhaust gas characteristic.

If SUML > SL2, the routine goes to a step S104. Due to the worsening of the air/fuel mixture ratio deviated largely toward the richened air/fuel mixture side, the concentration of CO and HC in the exhaust gas tends to be increased.

For example, such a display instrument as installed in the vicinity to the driver's seat is used to alert the driver.

On the other hand, in a step S103, when the total sum SUML of the leaned controlled variable is below the threshold level SL2, the CPU deems that some inconveniences such that the air/fuel mixture ratio is deviated largely to the richer side have not been generated, the routine jumps to a step S105.

Figure 10:
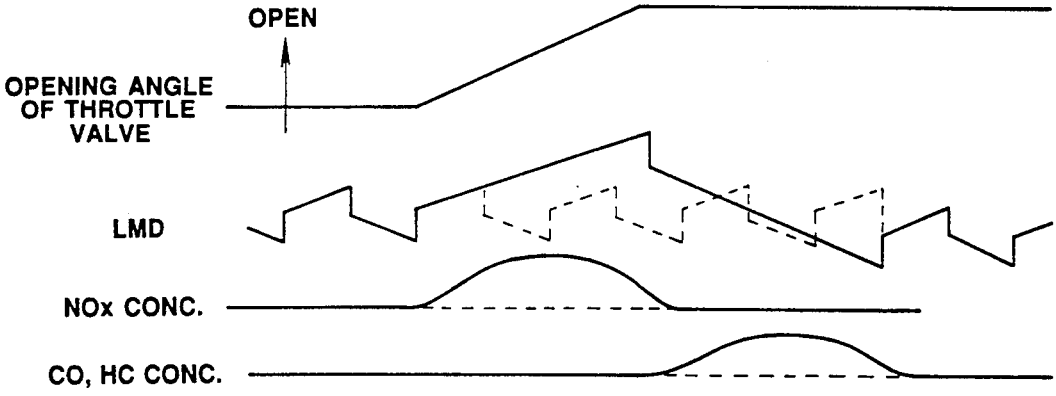
FIG. 10 is integrally timing charts for explaning a variation of the feedback correction coefficient during occurrence in a base air/fuel mixture ratio stepwise difference due to a change in the engine driving condition.
Figure 16:
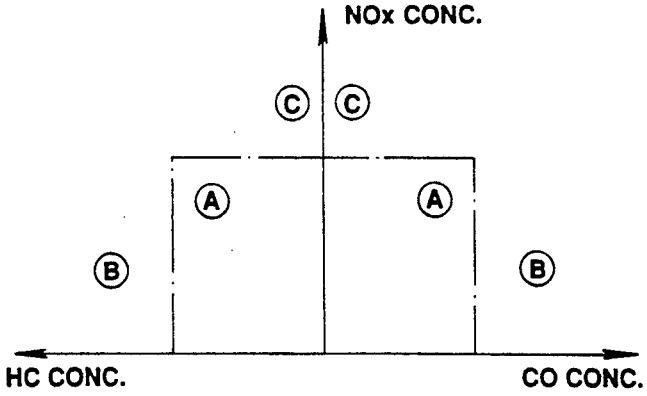
FIGS. 13 through 16 are characteristic graphs for explaining a problem of the self diagnose on the basis of an average value of the air/fuel mixture ratio learning correction value described in the BACKGROUND OF THE INVENTION.

As described above, if the total sums SUMR or SUMLof the richened or leaned controlled variables exceed the predetermined threshold levels, the CPU can monitor, particularly, the change in the exhaust gas characteristic (refer to FIG. 10) due to the occurrence in the base air/fuel mixture ratio stepwise difference when the driving condition is varied.

In the next step S105, the CPU calculates an average value SUM between the total sum SUMR of the richened controlled variable and SUML of the leaned controlled variable.

Then, in a step S106, the CPU compares the average value SUM and previously set threshold value SL3.

When the average value SUM is less that the threshold value SL3, the variation width and period of the correction coefficient LMD' are abnormally small.

In this case, the worsening of the air/fuel mixture ratio controlled state can be estimated due to the abnormality in the correction state due to the correction coefficient LMD.

However, since, due to the abnormality, the distinction of whether the actual air/fuel mixture ratio tends to be deviated in the richer air/fuel mixture direction than the target air/fuel mixture ratio.

It is estimated that the large leaned control is required as described above. The richened tendency of the air/fuel mixture ratio estimates the increase in the concentrations of CO and HC as the exhaust gas characteristic.

If SUML > SL2, the routine goes to a step S104. Due to the worsening of the air/fuel mixture ratio controllability deviated largely toward the rich side, the fact that the concentrations of CO and HC tend to be increased in the exhaust gas is alerted to the driver through the display instrument installed, e.g., in the vicinity to the driver's seat.

On the other hand, when the CPU determines that the total sum SUML of the leaned controlled variable is less than the threshold value SL2, the CPU deems that such an inconvenience that the air/fuel mixture ratio is largely deviated to the rich side or to the lean side.

In a step S107, the abnormality of concentrations of NOx, CO, and HC is displayed or alerted.

Figure 11:
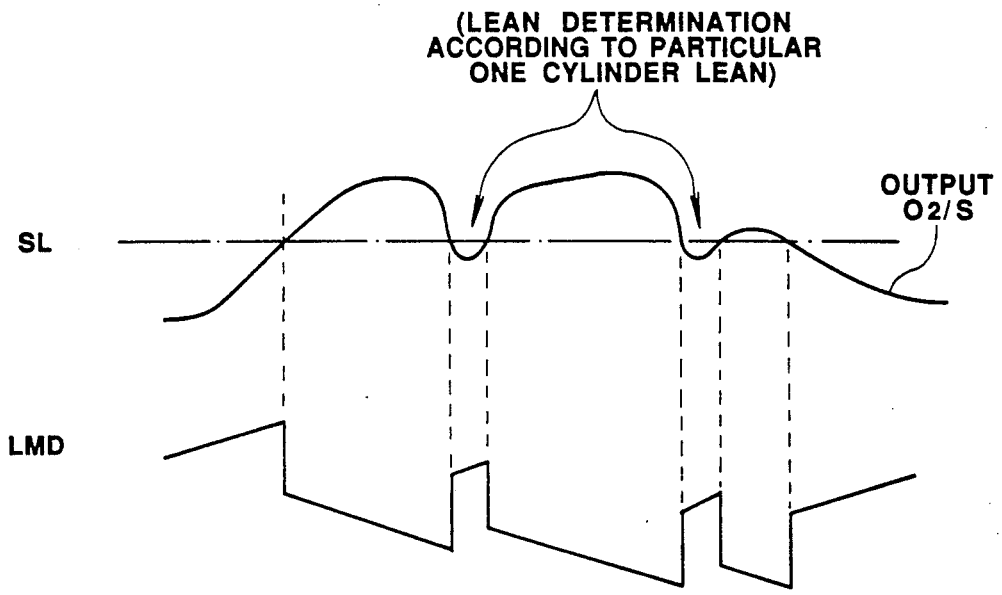
FIG. 11 is an integrally timing chart for explaining the air/fuel mixture ratio feedback control routine in a case where only the air/fuel mixture ratio for a particular engine cylinder becomes lean.

For example, in a case where only one particular cylinder from among a plurality of cylinders is leaned due to the clogging of the fuel injection valve and the exhaust gas corresponding to the leaned air/fuel mixture ratio causes the output of the oxygen concentration sensor 16 as shown in FIG. 11 to detect the exhaust gas from one of the cylinders in the leaned state in the state where it is temporarily reduced, the temporary leaning deems the reverse in the air/fuel mixture ratio and, consequently, the addition of the proportional control is resulted.

The control period of the correction coefficient LMD becomes shorter as compared with the normal time of the control period of the correction coefficient LMD. The average value SUM becomes smaller.

Figure 12:
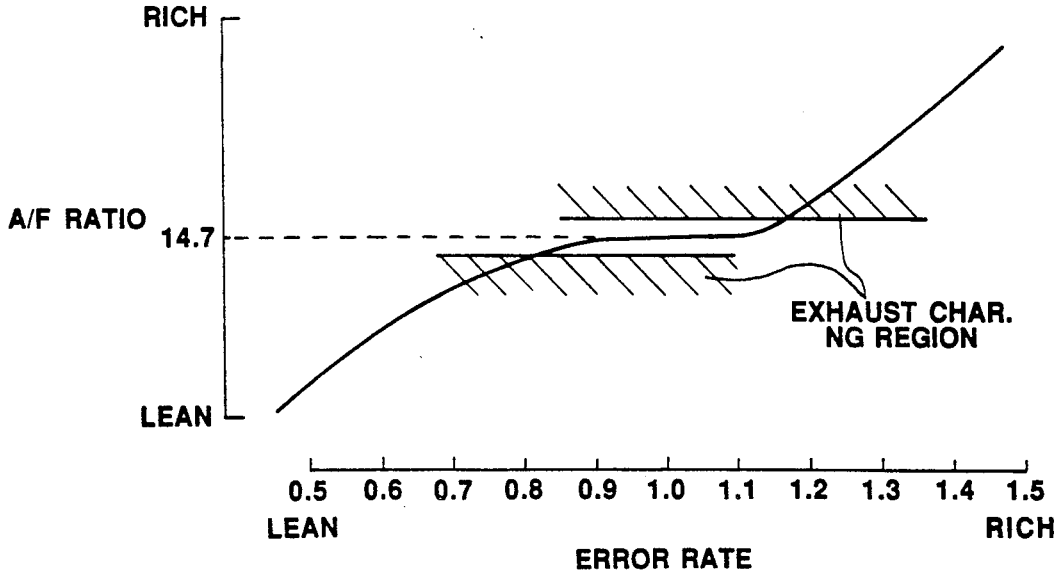
FIG. 12 is a characteristic graph of a variation in an average air/fuel mixture ratio in a case where only the air/fuel mixture ratio for the particular engine cylinder is varied.
Figure 13:
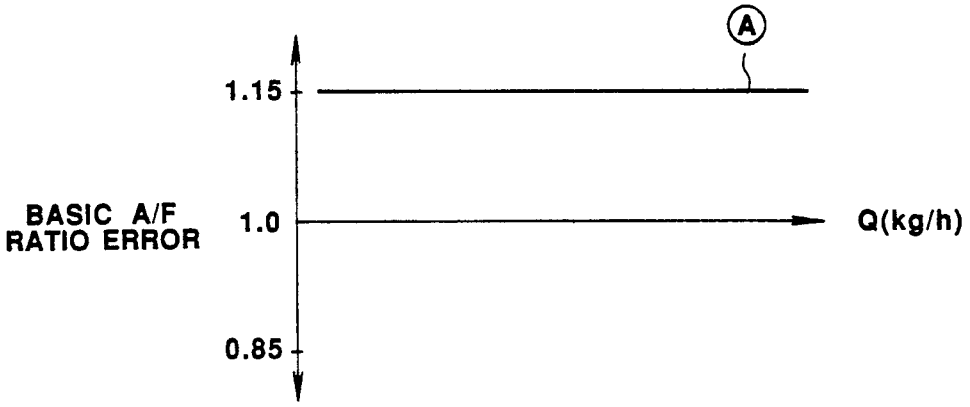
Figure 14:
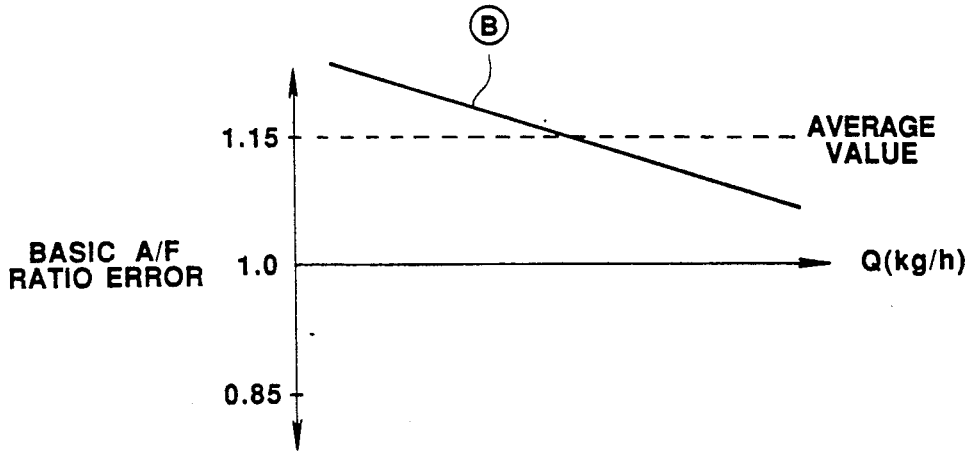
Figure 15:
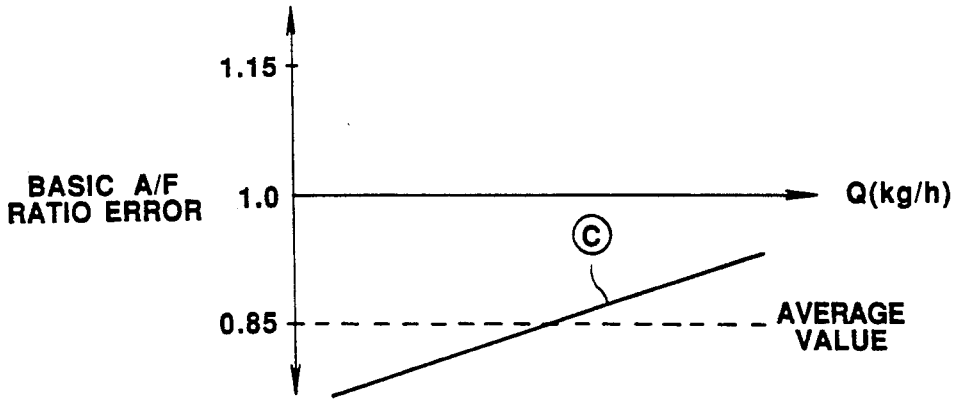

As described above, if only the particular cylinder air/fuel mixture ratio becomes leaned, the average air/fuel mixture ratio derived as the result of control of the air/fuel mixture ratio feedback correction control becomes lean, as shown in FIG. 12. Conversely, if only the air/fuel mixture ratio for the particular cylinder becomes richened, the average air/fuel mixture ratio derived as the result of the air/fuel mixture ratio feedback correction control becomes also richened.

Hence, if the average value SUM is below the threshold value SL3, the air/fuel mixture ratio only for the particular engine cylinder may be richened.

It is also noted that since, as described above, in a case where only the air/fuel mixture ratio for the particular air/fuel mixture ratio is deviated from the target air/fuel mixture ratio, it is difficult to diagnose it from a change width of the air/fuel mixture ratio feedback correction coefficient LMD, it is preferable to grasp the controlled variables of the air/fuel mixture ratio from both parameters between the change width of the air/fuel mixture ratio and control time.

As described above, when the deviation of the air/fuel mixture ratio due to its abnormality in the fuel supply control system is diagnosed on the basis of the total sum of the richened controlled variable SUMR and the total sum of the leaned controlled variable SUML, the routine goes to the next step S108 in which the total sums of SUMR and SUML are respectively reset to zero and the controlled data of the air/fuel mixture ratio within the predetermined period of time (within the execution period of time of the flowchart of FIG. 7) are newly accumulated.

According to the preferred embodiment, since the CPU executes the self diagnose on the basis of the movement of the air/fuel mixture ratio feedback correction coefficient LMD, it is not necessary to wait for the advance in the learning in the case where the diagnoses on the basis of the learning correction coefficient KBLRC are executed. In addition, since the self diagnoses in the fuel supply control system related to the exhaust characteristic can be made, it is possible to alert the driving under such a condition that the exhaust gas characteristic becomes worsened.

It is noted that, in the preferred embodiment, the total sums of the richened controlled variable SUMR and total sum SUML of the leaned controlled variable as a representative value of the air/fuel mixture ratio feedback correction coefficient LMD (air/fuel mixture ratio feedback controlled variable) in the predetermined period of time are corrected by means of the correction coefficient KREF determined on the basis of basic fuel injection quantity Tp and engine revolution speed N so that the correction coefficient LMD at the different driving condition can equally be treated. However, it is preferable to correct the threshold level at the different conditions.

It is noted that the predetermined period of time to monitor the movement of the correction coefficient LMD requires a relatively long time for five minutes through ten minutes and it is desireble to grasp the value corresponding to the driving condition including the steady-state driving and transient driving.

In this case, since it is difficult to vary the threshold level properly according to the driving condition, it is desirable to correct the varied data on the correction coefficient LMD according to the driving condition as in the preferred embodiment.

Although in the preferred embodiment the threshold levels SL1 and SL2 individually in the rich side and lean side are installed so as to be diagnosed and the abnormality of the exhaust gas component concentration is classified into NOx component and CO component and is diagnosed, a common threshold level to the rich side and lean side may be installed so as to determine the abonormality thereof and as the result of diagnose mere the deviation of air/fuel mixture ratio may be alerted.

Furthermore, the sampling may be made individually for the data on the change width of the air/fuel mixture ratio correction coefficient LMD, control time of the rich and lean states and the individual self-diagnose may be carried out on the basis of the individual data.

Although the data on the air/fuel mixture ratio controlled variable in the predetermined period of time are accumulated, the average value of the air/fuel mixture ratio controlled variables within the predetermined period of time may be calculated.

As described hereinabove, since in the self-diagnose apparatus and method according to the present invention the controlled state of the air/fuel mixture ratio can be diagnosed correlated to the exhaust gas characteristic on the basis of the air/fuel mixture ratio feedback controlled variable, it is possible to monitor the change in the exhaust gas characteristic according to the variation in the base air/fuel mixture ratio caused by the failure or deterioration of the componets of the fuel injection system and engine and the variation in the exhaust gas characteristic due to the variation in the base air/fuel mixture ratio can be monitored.

For example, the worsening of the exhaust gas characteristic such that the exhaust gas characteristic which exceeds the statutory limit value can sequentially be monitored.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A self diagnosing apparatus for a fuel supply control system in an internal combustion engine, comprising:

a) first detecting means for detecting an air/fuel mixture ratio of an air/fuel mixture supplied to the engine and outputting a first signal indicative of the actual air/fuel mixture ratio;

b) second detecting means for detecting an engine driving condition and outputting a second signal indicative of the engine driving condition;

b) air/fuel mixture ratio feedback controlled variable setting means, responsive to the output first and second signals from the first and second detecting means, for comparing the actual air/fuel mixture ratio with a target air/fuel mixture ratio and for setting and determining an air/fuel mixture ratio feedback controlled variable on the basis of the first and second signals which serves to correct the air/fuel mixture ratio of the air/fuel mixture to be supplied to the engine according to a result of comparison so that the actual air/fuel mixture ratio is approached to a target air/fuel mixture ratio;

c) air/fuel mixture ratio decrement/increment correcting means for controlling the fuel supply quantity related to the air/fuel mixture ratio to be supplied to the engine so as to correct incrementally or decrementally the actual air/fuel mixture ratio on the basis of the air/fuel mixture feedback controlled variable set by the air/fuel mixture feedback controlled variable setting means; and d) air/fuel mixture ratio increment/decrement control diagnosing means for diagnosing an air/fuel mixture ratio controlled state of the fuel supply control system on the basis of at least one of either each magnitude by which the air/fuel mixture ratio feedback controlled variable is changed to richen or lean the air/fuel mixture ratio so as to approach the actual air/fuel mixture ratio to the target air/fuel mixture ratio or a control duration of time during which the fuel supply control system executes the correction on the actual air/fuel mixture ratio by means of the air/fuel mixture ratio feedback controlled variable.

2. A self diagnosing apparatus for a fuel supply control system in an internal combustion engine as set forth in claim 1, wherein said air/fuel mixture ratio increment/decrement control diagnosing means, to diagnose the air/fuel mixture ratio controlled state, compares a representative value of either the magnitude of the change in the air/fuel mixture ratio feedback controlled variable for a predetermined period of time or the control duration of time for the predetermined period of time with a threshold level previously set according to the engine driving condition.

3. A self diagnosing apparatus for a fuel supply control system in an internal combustion engine as set forth in claim 1, wherein said air/fuel mixture ratio increment/decrement control diagnosing means, to diagnose the air/fuel mixture ratio controlled state, compares representative values of either the magnitude of the decremental or incremental change in the air/fuel mixture ratio feedback controlled variable for a predetermined period of time or the control duration of time for the predetermined period of time with respective theshold levels individually previously set for respective decremental and incremental change side of the air/fuel mixture ratio feedback controlled variable.

4. A self diagnosing apparatus for a fuel supply control system in an internal combustion engine as set forth in claim 3, wherein said respresentative value is expressed as follows:

$$SUMR \leftarrow SUMR + \{[(a-b) \times tm]/KREF\text{-}1.0\},$$

wherein SUMR denotes a total sum of the controlled variables by means of an air/fuel feedback correction coefficient LMD used previously to richen the air/fuel mixture ratio so as to approach to the target air/fuel mixture ratio, (a-b) denotes a change width by which the air/fuel mixture ratio feedback correction coefficient LMD is changed to richen the air/fuel mixture ratio in a state of a previous air/fuel mixture ratio leaned state, tm denotes the duration of time during which a richened control of the air/fuel mixture ratio has been carried out in the previous air/fuel mixture ratio leaned state, and KREF denotes a correction coefficient set on the basis of the engine driving condition.

5. A self diagnosing apparatus for a fuel supply control system in an internal combustion engine as set forth in claim 4, wherein said representative value is expressed as follows:

$$SUML \leftarrow SUML + \{[(a-b) \times tm]/KREF\text{-}1.0\},$$

wherein SUML denotes a total sum of the controlled variables by means of the air/fuel feedback correction coefficient LMD used previously to lean the air/fuel mixture ratio so as to approach to the target air/fuel mixture ratio, (a-b) denotes a change width by which the air/fuel mixture ratio feedback correction coefficient LMD is changed to lean the air/fuel mixture ratio in a state of a previous air/fuel mixture ratio richened state, tm denotes the duration of time during which a lean control of the air/fuel mixture ratio has been carried out in the previous air/fuel mixture ratio richened state, and KREF denotes a correction coefficient set on the basis of the engine driving condition.

6. A self diagnosing apparatus for a fuel supply control system in an internal combustion engine as set forth in claim 5, which further includes alarm means installed on an instrument panel of a vehicle in which the self-diagnosing apparatus is installed and wherein said predetermined time is approximately five minutes and said SUMR is compared with a first threshold value (SL1) and wherein when said SUMR exceeds SL1, the alarm means is operated to alert the vehicle driver of the result of diagnose.

7. A self diagnosing apparatus for a fuel supply control system in an internal combustion engine as set forth in claim 6, wherein after the comparison of said SUMR with SL1, said SUML is compared with a second threshold value (SL2) and wherein when the SUML exceeds the SL2, the alarm means is operated to alert the vehicle driver of the result of diagnose on its comparison.

8. A self diagnosing apparatus for a fuel supply control system in an internal combustion engine as set forth in claim 7, wherein said diagnosing means further carries out the following arithmetic operation after the comparison of said SUML with SL2:

$$SUM \leftarrow \{(SUMR + SUML)/2\}.$$

9. A self diagnosing apparatus for a fuel supply control system in an internal combustion engine as set forth in claim 8, wherein sais SUM is compared with a third threshold value (SL3) and wherein when said SUM exceeds SL3, said alarm means is operated to alert the driver of the result of diagnose on its comparison.

10. A self diagnosing apparatus for a fuel supply control system in an internal combustion engine as set forth in claim 9, wherein when all comparisons on said SUMR, SUML, and SUM are ended, said SUMR and SUML are reset to zero.

11. A self diagnosing apparatus for a system for controlling and learning an air/fuel mixture ratio applicable to an internal combustion engine installed in an automotive vehicle, comprising:

a) first means for detecting an engine driving condition including a driving parameter related to an intake air quantity sucked into the engine;

b) second means for setting a basic fuel supply quantity Tp on the basis of the engine driving condition;

c) third means for detecting an air/fuel mixture ratio of the supplied air/fuel mixture of the engine;

d) fourth means for comparing the detected air/fuel mixture ratio with a target air/fuel mixture ratio and for setting an air/fuel mixture ratio feedback correction coefficient LMD used to correct the basic fuel injection quantity so as to approach the actual air/fuel mixture ratio to the target air/fuel mixture ratio;

e0 fifth means for rewritably storing an air/fuel mixture ratio learning correction coefficient KBLRC for each driving region, a whole driving region on the engine driving condition being divided into a plurality of subdivided driving regions and the learning correction coefficient being used to correct the basic fuel supply quantity;

f) sixth means for learning a deviation of a value of the air/fuel mixture ratio feedback correction coefficient to a target convergence value and for modifying and rewriting the air/fuel mixture ratio learning correction coefficient stored so as to correspond to one of the dubdivided driving regions in the fifth means so that the deviation thereof is reduced;

g) seventh means for determining the present corresponding driving region in the fifth means as a learned region when the value of the air/fuel mixture ratio feedback correction coefficient substantially coincides wih the target convergence value and for storing a result of determination on the learned region according to each driving region;

h) eighth means for driving a final fuel supply quantity on the basis of the basic fuel injection quantity Tp, air/fuel mixture ratio feedback correction coefficient LMD, and the learned air/fuel mixture ratio learning correction coefficient KBLRC stored so as to correspond to the present driving region, the fuel quantity being a quantity of fuel to be supplied to the engine; and i) ninth means for diagnosing an air/fuel mixture ratio controlled state of the fuel supply control system on the basis of at least one of either a sum of a magnitude by which the air/fuel mixture ratio feedback correction coefficient LMD is decrementally or incrementally changed to richen or lean the air/fuel mixture ratio so as to approach the actual air/fuel mixture ratio to the target air/fuel mixture ratio or a control duration of time during which the fuel supply control system executes the correction of the basic fuel supply quantity to calculate the final fuel supply quantity on the actual air/fuel mixture ratio by means of the air/fuel mixture ratio feedback correction coefficient LMD.

12. A self diagnosing apparatus for a system for controlling and learning an air/fuel mixture ratio applicable to an internal combustion engine installed in an automotive vehicle as set forth in claim 11, wherein the air/fuel mixture ratio learning and controlling system is provided with a plurality of fuel injection valves for respective engine cylinders and which further includes tenth means for informing the result of the diagnose by means of said ninth means, said thenth means including displaying means, installed on an instrument panel of the vehicle, for displaying the worsening of an exhaust gas characterisitc according to the result of diagnose.

13. A self diagnosing apparatus for a system for controlling and learning an air/fuel mixture ratio applicable to an internal combustion engine installed in an automotive vehicle as set forth in claim 12, wherein said ninth means calculates the following total sum SUMR of each magnitude by which the air/fuel mixture ratio feedback correction coefficient LMD is changed to richen the air/fuel mixture ratio so as to approach the actual air/fuel mixture ratio to the target air/fuel mixture ratio during a previous leaned state of the air/fuel mixture ratio:

$$SUMR \leftarrow SUMR + \{(a+b) \times \qquad /KREF - 1.0\},$$

wherein (a−b) denotes a change width by which the air/fuel mixture ratio feedback correction coefficient LMD is changed to richen the air/fuel mixture ratio in a state of a previous air/fuel mixture ratio leaned state, tm denotes the duration of time during which a richened control of the air/fuel mixture ratio has been carried out in the previous air/fuel mixture ratio leaned state, and KREF denotes a correction coefficient set on the basis of the engine driving condition and wherein said SUMR is updated whenever a proportion control for the feedback correction coefficient LMD is carried out.

14. A self diagnosing apparatus for a system for controlling and learning an air/fuel mixture ratio applicable to an internal combustion engine installed in an automotive vehicle as set forth in claim 13, wherein said ninth means calculates the following total sum SUML of each magnitude by which the air/fuel mixture ratio feedback correction coefficient LMD is changed to lean the air/fuel mixture ratio so as to approach the actual air/fuel mixture ratio to the target air/fuel mixture ratio during a previous richened state of the air/fuel mixture ratio:

SUML←SUML+{(a−b)×tm/KREF−1.0}.

wherein (a−b) denotes a change width by which the air/fuel mixture ratio feedback correction coefficient LMD is changed to lean the air/fuel mixture ratio in a state of a previous air/fuel mixture ratio richened state, tm denotes the duration of time during which a leaned control of the air/fuel mixture ratio has been carried out in the previous air/fuel mixture ratio richened state, and KREF denotes a correction coefficient set on the basis of the engine driving condition and wherein said SUMR is updated whenever a proportion control for the feedback correction coefficient LMD is carried out.

15. A self diagnosing apparatus for a system for controlling and learning an air/fuel mixture ratio applicable to an internal combustion engine installed in an automotive vehicle as set forth in claim 14, wherein said ninth means first compares said SUMR with a first threshold value (SL1) to determine whether said SUMR exceeds said SL1, said SL1 being previously determined according to the engine driving condition and compares said SUML with a second threshold value (SL2) to determine whether said SUMR exceeds said SL2, both results of comparisons being informed through said informing means and said comparions being carried out whenever a predetermined period of time has passed.

16. A self diagnosing apparatus for a system for controlling and learning an air/fuel mixture ratio applicable to an internal combustion engine installed in an automative vehicle as set forth in claim 15, wherein said ninth means further calculates as follows:

SUM←(SUMR+SUML)/2, and wherein said SUM is compared with a third threshold value (SL3) to determine whether SUM exceeds said SL3, three comparison results being informed through said informing means.

17. A self diagnosing apparatus for a system for controlling and learning an air/fuel mixture ratio applicable to an internal combustion engine installed in an automotive vehicle as set forth in claim 16, which further includes eleventh means for estimating and learning the air/fuel mixture ratio learning correction coefficients (KBLRC2) corresponding to the other diriving regions which are adjacent in terms of the present driving condition to one of the driving regions at which the corresponding learning correction coefficient is rewritten by the sixth means.

18. A self diagnosing apparatus for a system for controlling and learning an air/fuel mixture ratio applicable to an internal combustion engine installed in an automotive vehicle as set forth in claim 17, which further includes: twelfth means for determining a magnitude (Stress) of inappropriateness of the result of learning on the air/fuel mixture ratio on the basis of the deviation of the air/fuel mixture ratio correction value of LMD from its target convergence value when the driving region corresponding to the present driving conditin is exhanged from the present driving region to any one of the other driving regions; and thirteenth means for reducing the number of the driving regions at which the learning correction coefficients are learned as the learnings on the air/fuel mixture ratio correction coefficients are advanced with the number of the drivng regions at which the learning correction coefficients are rewriten together with the learning correction coefficient of the region to be rewritten by means of said sixth means.

19. A self diagnosing apparatus for a system for controlling and learning an air/fuel mixture ratio applicable to an internal combustion engine installed in an automotive vehicle as set forth in claim 18, wherein the learning correction coefficient KBLRC is constituted by a first air/fuel mixture ratio learning correction coefficient KBLRC0 for the whole engine driving region, a second air/fuel mixture ratio learning correction coefficient KBLRC1 for each subdivided driving region on a 4×4 lattice learning map, and a third air/fuel mixture ratio learning correction coefficient KBLRC2 for each subdivided driving region on a 16×16 lattice learning map and wherein the learnings of the air/fuel mixture ratio learning correction coefficients are advanced from those of a wider driving region.

20. A self diagnosing method for a system for controlling and learning an air/fuel mixture ratio applicable to an internal combustion engine installed in an automotive vehicle, comprising the steps of:

a) detecting an engine driving condition including a driving parameter related to an intake air quantity sucked into the engine;

b) setting a basic fuel supply quantity Tp on the basis of the engine driving condition;

c) detecting an air/fuel mixture ratio of the supplied air/fuel mixture of the engine;

d) comparing the detected air/fuel mixture ratio with a target air/fuel mixture ratio and setting an air/fuel mixture ratio feedback correction coefficient LMD used to correct the basic fuel injection quantity so as to approach the actual air/fuel mixture ratio to the target air/fuel mixture ratio;

e) rewritably storing an air/fuel mixture ratio learning correction coefficient KBLRC for each driving region, a whole driving region on the engine driving condition being divided into a plurality of subdivided driving regions and the learning correction coefficient being used to correct the basic fuel supply quantity;

f) learning a deviation of a value of the air/fuel mixture ratio feedback correction coefficient to a target convergence value and modifying and rewriting the air/fuel mixture ratio learning correction coefficient stored so as to correspond to one of the dubdivided driving regions so that the deviation thereof is reduced;

g) determining the present corresponding driving region in the fifth means as a learned region when the value of the air/fuel mixture ratio feedback correction coefficient substantially coincides wih the target convergence value and storing a result of determination on the learned region according to each driving region;

h) deriving a final fuel supply quantity on the basis of the basic fuel injection quantity Tp, air/fuel mixture ratio feedback correction coefficient LMD, and teh learned air/fuel mixture ratio learning correction coefficient KBLRC stored so as to correspond to the present driving region, the fuel quantity being a quantity of fuel to be supplied to the engine; and i) self diagnosing an air/fuel mixture ratio controlled state of the fuel supply control system on the basis of at least one of either a sum of a magnitude by which the air/fuel mixture ratio feedback correction coefficient LMD is decrementally or incrementally changed to richen or lean the air/fuel mixture ratio so as to approach the actual air/fuel mixture ratio to the target air/fuel mixture ratio or a control duration of time during which the fuel supply control system executes the correction of the basic fuel supply quantity to calculate the final fuel supply quantity on the actual air/fuel mixture ratio by means of the air/fuel mixture ratio feedback correction coefficient LMD.

* * * * *